US009175618B2

(12) United States Patent
Uchiyama et al.

(10) Patent No.: US 9,175,618 B2
(45) Date of Patent: Nov. 3, 2015

(54) ENGINE CONTROL DEVICE AND ENGINE CONTROL METHOD

(71) Applicant: SUZUKI MOTOR CORPORATION, Hamamatsu-Shi (JP)

(72) Inventors: Takahiro Uchiyama, Hamamatsu (JP); Tomoo Nagumo, Hamamatsu (JP); Kenichi Tsutsumi, Hamamatsu (JP); Hiroaki Otake, Hamamatsu (JP)

(73) Assignee: SUZUKI MOTOR CORPORATION, Hamamatsu-Shi (JP)

( * ) Notice: Subject to any disclaimer, the term of this patent is extended or adjusted under 35 U.S.C. 154(b) by 403 days.

(21) Appl. No.: 13/729,241

(22) Filed: Dec. 28, 2012

(65) Prior Publication Data

US 2013/0167802 A1 Jul. 4, 2013

(30) Foreign Application Priority Data

Dec. 28, 2011 (JP) ..... 2011-288662

(51) Int. Cl.
*F02D 41/22* (2006.01)
*F02D 31/00* (2006.01)
(Continued)

(52) U.S. Cl.
CPC ..... *F02D 31/005* (2013.01); *F02D 41/221* (2013.01); *F02P 9/005* (2013.01);
(Continued)

(58) Field of Classification Search
CPC ..... F02P 5/04; F02P 5/151; F02P 11/00; F02P 11/02; F02P 11/06; F02P 9/002; F02P 9/005; F02D 41/22; F02D 41/221; F02D 2200/0404; F02D 2200/0406; F02D 17/04; F02D 2200/101; F02D 2200/1012; F02D 31/005
USPC ..... 701/101, 102, 107, 110; 123/339.1, 123/339.11, 339.23, 406.11–406.13, 123/406.52, 339.15; 73/114.36, 114.37
See application file for complete search history.

(56) References Cited

U.S. PATENT DOCUMENTS 5,094,213 A * 3/1992 Dudek et al. ..... 477/121
5,293,553 A * 3/1994 Dudek et al. ..... 701/102
(Continued)

FOREIGN PATENT DOCUMENTS

DE 10 2007 021 469 A1 11/2008
JP 2010-156268 A 7/2010

OTHER PUBLICATIONS

Extended European Search Report for Application No. 12199415.6, dated Sep. 26, 2014.

*Primary Examiner* — Stephen K Cronin
*Assistant Examiner* — Robert Werner
(74) *Attorney, Agent, or Firm* — Barnes & Thornburg LLP

(57) ABSTRACT

An engine of a vehicle is provided with an engine control device including an idle speed control (ISC) device provided for an intake bypass passage connecting an upper side and a lower side of a throttle valve installed in an intake passage so as to control an idle speed of the engine by adjusting an amount of air flowing through the intake bypass passage at a time of idling of the engine. The engine control device includes a throttle opening degree sensor disposed in the intake passage and configured to detect a degree of opening of the throttle valve, an intake pressure sensor disposed in the intake passage and configured to detect an intake negative pressure at the lower side of the throttle valve, and a control unit configured to control an output of the engine. The control unit is configured to perform an engine output suppression control of suppressing the output of the engine after determining that an ISC valve of the ISC device is abnormal in a case where the degree of opening of the throttle valve detected by the throttle opening degree sensor is within a predetermined range and when the intake negative pressure detected by the intake pressure sensor is low compared with a threshold value.

14 Claims, 16 Drawing Sheets

(51) Int. Cl.
*F02P 11/02* (2006.01)
*F02P 9/00* (2006.01)

(52) U.S. Cl.
CPC ..... *F02P 11/02* (2013.01); *F02D 2200/0404* (2013.01); *F02D 2200/0406* (2013.01); *F02D 2200/101* (2013.01); *F02D 2200/1012* (2013.01)

(56) References Cited

U.S. PATENT DOCUMENTS

| | | | | |
|---|---|---|---|---|
| 5,513,610 | A * | 5/1996 | Okamoto et al. | 123/339.15 |
| 6,158,420 | A | 12/2000 | Ohsaki et al. | |
| 7,954,473 | B2 * | 6/2011 | Ota | 123/339.1 |
| 2002/0113439 | A1 | 8/2002 | Thomas et al. | |
| 2008/0178838 | A1 | 7/2008 | Ota | |

* cited by examiner

ENGINE CONTROL DEVICE AND ENGINE CONTROL METHOD

This patent application claims priority to Japanese Patent Application No. 2011-288662, filed 28 Dec. 2011, the disclosure of which is incorporated herein by reference in its entirety.

BACKGROUND OF THE INVENTION

1. Field of the Invention

The present invention relates to a device for controlling an engine including an ISC (idle speed control) device for controlling the idle speed of the engine and also relates to a method of controlling such engine.

2. Description of the Related Art

As a conventional engine, there is known an engine including an ISC device that controls the idle speed to be at a target speed by having an upper side and a lower side of a throttle valve installed in an intake passage connected by an intake bypass passage. The ISC device includes an ISC valve disposed in the intake bypass passage so as to adjust the amount of air flowing through the intake bypass passage by the ISC valve at the time of idling.

With a vehicle on which an engine including such an ISC device is mounted, an ISC valve of the ISC device may become fixed (adheres) at an open state due to a short circuiting of wirings, carbon deposit or the like on the ISC valve. In a state where the ISC valve is fixed, the amount of intake air into the engine increases compared to a normal state (non-fixed state), and thus, the idle speed of the engine increases. As a result, there is a possibility that an automatic centrifugal clutch is connected even if the throttle valve is completely closed, and that the vehicle is unintentionally started.

Accordingly, as described, for example, in Patent Document 1 (Japanese Patent Laid-Open Publication No. 60-11648), a technique is proposed of calculating in advance the basic amount of air that is based on the degree of opening of a throttle valve and the engine speed, and determining an abnormality in an ISC valve when a measurement value of the amount of actually measured engine air intake exceeds the basic amount of air.

Furthermore, as described in Patent Document 2 (Japanese Patent Laid-Open Publication No. 8-86266), there is provided a technique of calculating the actual amount of intake air flowing through an ISC valve by calculating the amount of intake air flowing through a throttle valve based on the degree of opening of the throttle valve and deducting the amount of intake air flowing through the throttle valve from the amount of intake air (a measurement value) of the entire mechanism, and determining an abnormality in the ISC valve in a case where there is a predetermined or greater deviation between the actual amount of intake air and the amount of intake air calculated based on a set degree of opening of the ISC valve.

The conventional techniques described in Patent Documents 1 and 2 are suitable when applied to a so-called L-jetronic fuel injection device that detects the amount of intake air into the engine by an air flow sensor, but are not suitable for a D-jetronic fuel injection device that detects an intake air pressure (an intake negative pressure) and decides the amount of fuel injection, because an air flow sensor has to be separately provided.

Generally, the D-jetronic fuel injection device is said to be more advantageous compared to the L-jetronic fuel injection device in a viewpoint such that, since the air flow sensor is unnecessary, an increase in the intake resistance can be prevented.

Furthermore, in contrast to the L-jetronic fuel injection device that decides the optimal amount of fuel injection after measuring the actual amount of intake air, the D-jetronic fuel injection device decides the amount of fuel injection by measuring a change in the intake negative pressure that causes a change in the amount of intake air, and thus, it is also advantageous in that it has good responsiveness for the output change with respect to a throttle operation.

For these reasons, the D-jetronic fuel injection device is widely used in motorcycles and all terrain vehicles and, accordingly, it is difficult to apply the conventional technique described in Patent Document 1 or 2 to motorcycles and all terrain vehicles.

SUMMARY OF THE INVENTION

The present invention is made in consideration of the circumstance described above, and an object of the present invention is to provide an engine control device and an engine control method capable of preventing an excessive increase in the engine speed at the time of an abnormality such as fixation of an ISC valve of an ISC device in an open state.

The above and other objects can be achieved according to the present invention by providing, in one aspect, an engine control device of an engine including an idle speed control (ISC) device provided for an intake bypass passage connecting an upper side and a lower side of a throttle valve installed in an intake passage so as to control an idle speed of the engine by adjusting an amount of air flowing through the intake bypass passage at a time of idling of the engine, the engine control device including: a throttle opening degree sensor disposed in the intake passage and configured to detect a degree of opening of the throttle valve; an intake pressure sensor disposed in the intake passage and configured to detect an intake negative pressure at the lower side of the throttle valve; and a control unit configured to control an output of the engine, wherein the control unit is configured to perform an engine output suppression control of suppressing the output of the engine after determining that an ISC valve of the ISC device is abnormal in a case where the degree of opening of the throttle valve detected by the throttle opening degree sensor is within a predetermined range and when the intake negative pressure detected by the intake pressure sensor is low compared with a threshold value.

In another aspect of the present invention, there is also provided an engine control method for an engine including an ISC valve using the engine control device of the structure mentioned above, wherein an engine output suppression control of suppressing an output of the engine is performed after determining that the ISC valve is abnormal in a case where a degree of opening of the throttle valve is within a predetermined range and when an intake negative pressure at the lower side of the throttle valve in the intake passage is low compared with a threshold value.

According to the engine control device and the method of the present invention, when the degree of opening of a throttle valve is within a predetermined range and an intake negative pressure is below a threshold value, since an ISC valve of an ISC device is determined to be abnormal, an engine output suppression control of suppressing the output of the engine is performed an excessive increase in the engine speed can be prevented even if the amount of intake air supplied to the engine is not decreased at the time of an abnormality such as fixation of the ISC valve in an open state.

The nature and other characteristic features of the present invention will be made clearer from the following descriptions made with reference to the accompanying drawings.

DESCRIPTION OF THE PREFERRED EMBODIMENT

Hereinafter, embodiments for carrying out the present invention will be described based on the drawings. It is to be noted that terms of upper, lower, right, left and the like terms indication directions are used herein with reference to the illustrated states on the drawings or in a vehicle standing state.

Incidentally, the present invention is not limited to these embodiments.

[I] First Embodiment

FIGS. 1 to 14

Figure 1:
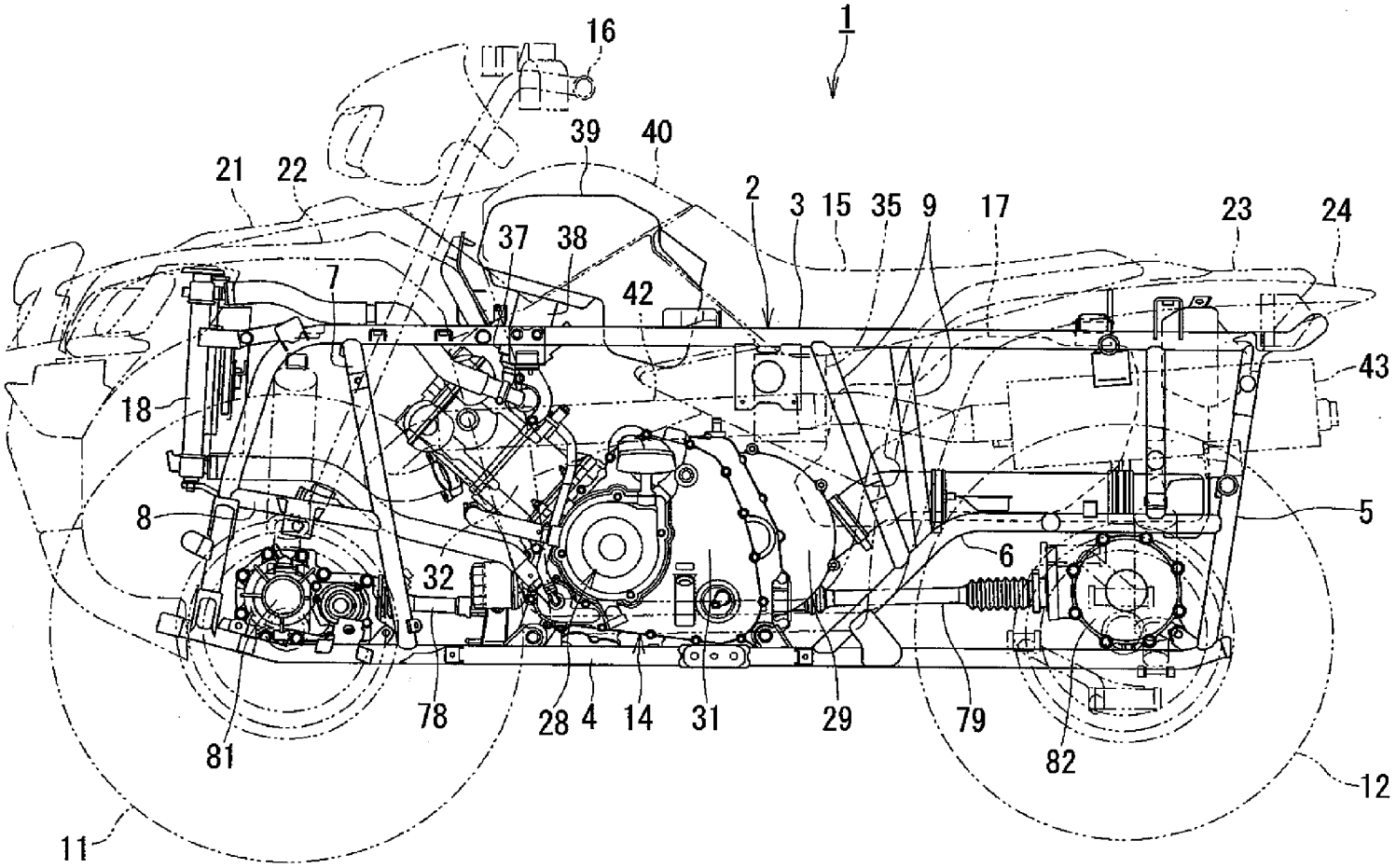
FIG. 1 is a transparent left side view showing an all terrain vehicle to which a first embodiment of an engine control device according to the present invention is applied.
Figure 2:
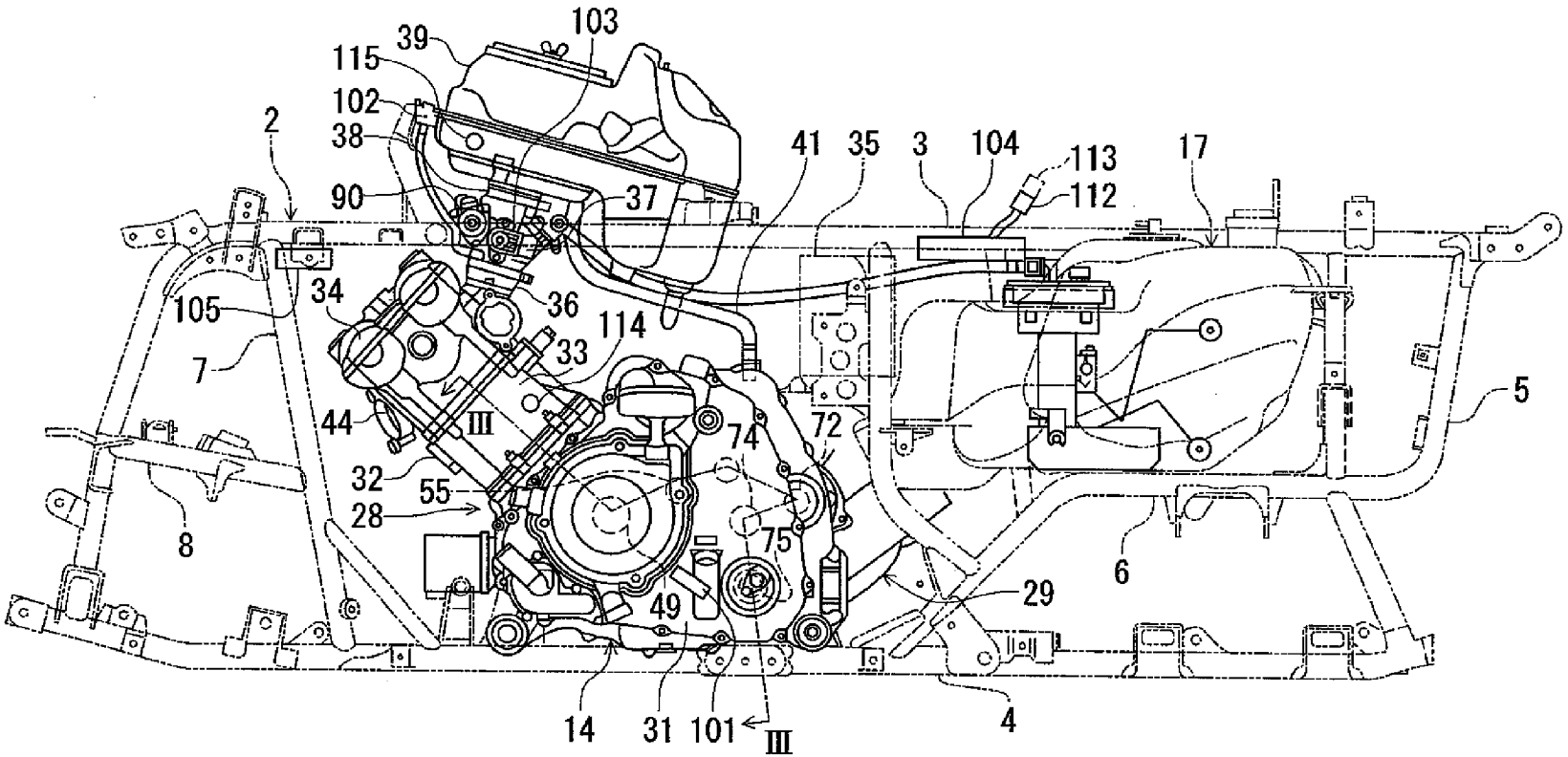
FIG. 2 is a transparent side view showing a vehicle body frame, an engine unit, a fuel tank and the like based on FIG. 1.

As shown in FIGS. 1 and 2, an all terrain vehicle 1 includes a vehicle body frame 2 assembled to provide a substantially cage-like shape by using, for example, steel pipe materials.

The vehicle body frame 2 includes a pair of left and right upper pipes 3 and lower pipes 4, a pair of left and right rear vertical pipes 5 vertically joining the rear ends of the upper and lower pipes, a pair of left and right rear horizontal pipes 6 longitudinally joining between the rear vertical pipes 5 and substantially middle portions of the lower pipes 4, a pair of left and right front vertical pipes 7 vertically joining between the upper pipes 3 and the lower pipes 4 at front portions, a pair of left and right front vertical pipes 8 longitudinally joining between the front vertical pipes 7 and front portions of the upper pipes 3, and a plurality of bridge members, not shown, joining between each of members 3, 4, 5, 6, 7 and 8 of the left and right pairs of pipes.

Front ends of the left and right upper pipes 3 are bent downward and fixed to front ends of the lower pipes 4.

Furthermore, a pair of left and right front wheels 11 and rear wheels 12 with wide, low-pressure tires are provided at the front and rear of the vehicle body frame 2 via a suspension mechanism, not shown. An engine unit 14 is suspended substantially in the middle of the vehicle body frame 2 at a position between the front wheels 11 and the rear wheels 12 and lower than the location of the upper pipes 3.

A saddle seat 15 is mounted at a rear upper part of the upper pipes 3, a steering handle 16 for steering the front wheels 11 is provided in front of the saddle seat 15, and a fuel tank 17 is provided under the seat 15 and behind the engine unit 14. Furthermore, a heat exchanger (an oil cooler, a radiator or the like) 18 of the engine unit 14 is installed at near the foremost part of the vehicle body frame 2.

A front cover 21 covering the upper front part of the vehicle body frame 2 is provided at the front part of the vehicle body, and front fenders 22 covering the left and right front wheels 11 are integrally or substantially integrally formed on the front cover 21. In addition, a rear cover 23 covering the upper rear part of the vehicle body frame 2 is provided at the rear part of the vehicle body, and rear fenders 24 covering the left and right rear wheels 12 are integrally or substantially integrally formed on the rear cover 23. Additionally, these members 21 to 24 are made as synthetic resin products, for example.

An engine 28 and a belt-type continuously variable transmission 29 are, for example, integrally formed as the engine unit 14. The engine 28 is a water-cooled 4-cycle single cylinder engine, for example, and is configured to include a crankcase 31 and a cylinder assembly 32 which is positioned, tilting forward at about 45 degrees, in front of the upper surface of the crankcase 31. The cylinder assembly 32 is configured to include a cylinder head 34 positioned above a cylinder block 33.

The cylinder assembly 32 and the crankcase 31 forming the engine unit 14, the transmission 29 and the fuel tank 17 are, when seen from the side of the vehicle, arranged in a manner of sequentially overlapping one another without being separated so as to be continuous in a substantially V-shaped manner. A battery 35 is arranged in the internal space of the V shape.

An engine intake system is arranged at a rear upper part of the cylinder assembly 32, at a front lower part of the seat 15. The engine intake system includes a throttle body 37 as an air-fuel mixture producing unit that is connected to an intake port on the back surface of the cylinder head 34 via an intake pipe 36, and an air cleaner 39 that is arranged above the throttle body 37 and in front of the seat 15.

The air cleaner 39 is connected to the upper side of the throttle body 37 via an intake tube 38, is arranged so as to protrude above the upper pipes 3 of the vehicle body frame 2, and is covered by a cleaner cover 40 made of the same material as that of the front cover 21, the rear cover 23 and the like.

Furthermore, a breeze hose 41 extending from an upper portion of the crankcase 31 of the engine unit 14 is connected to the air cleaner 39.

Figure 4:
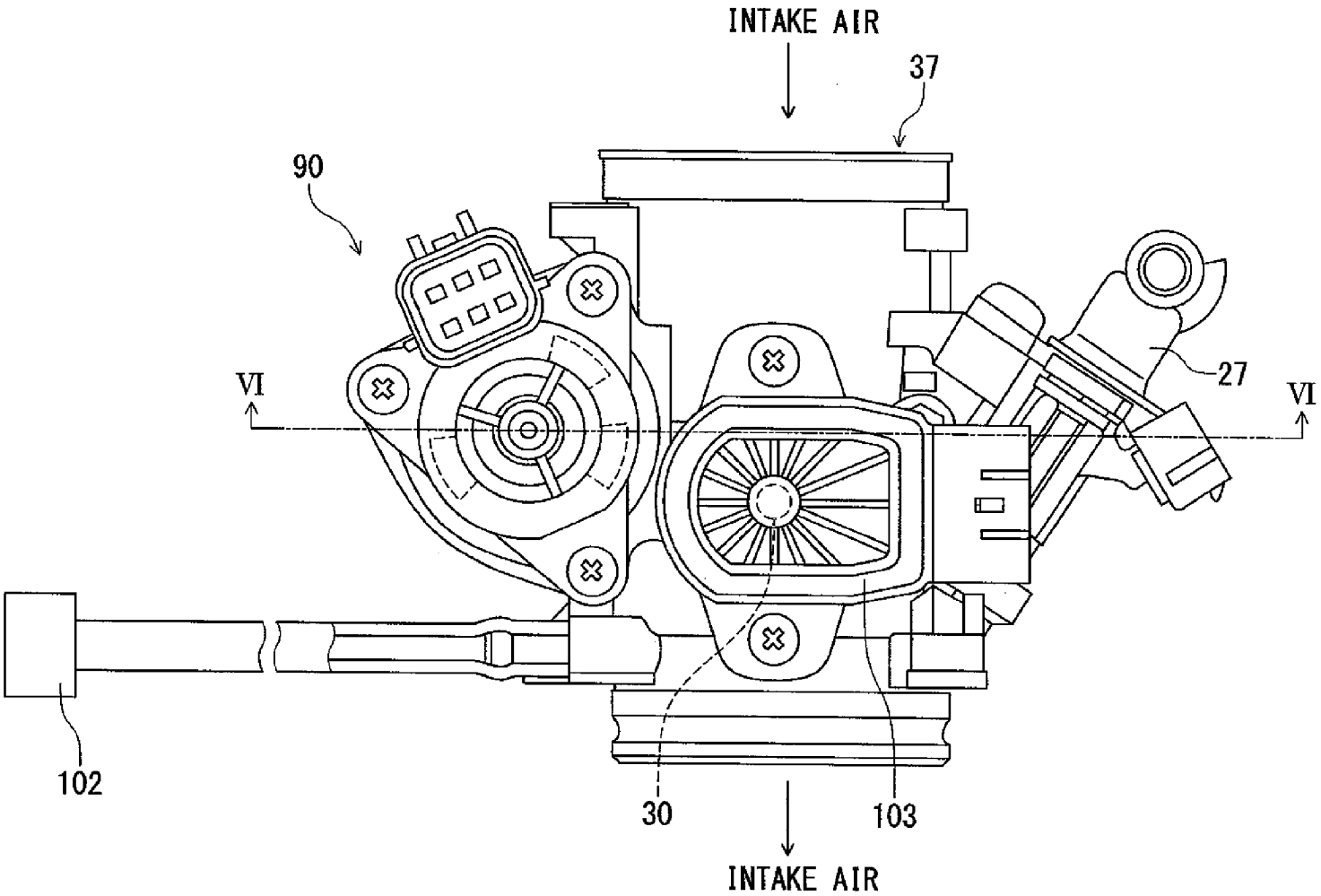
FIG. 4 is a front view of a throttle body in FIG. 2.
Figure 5:
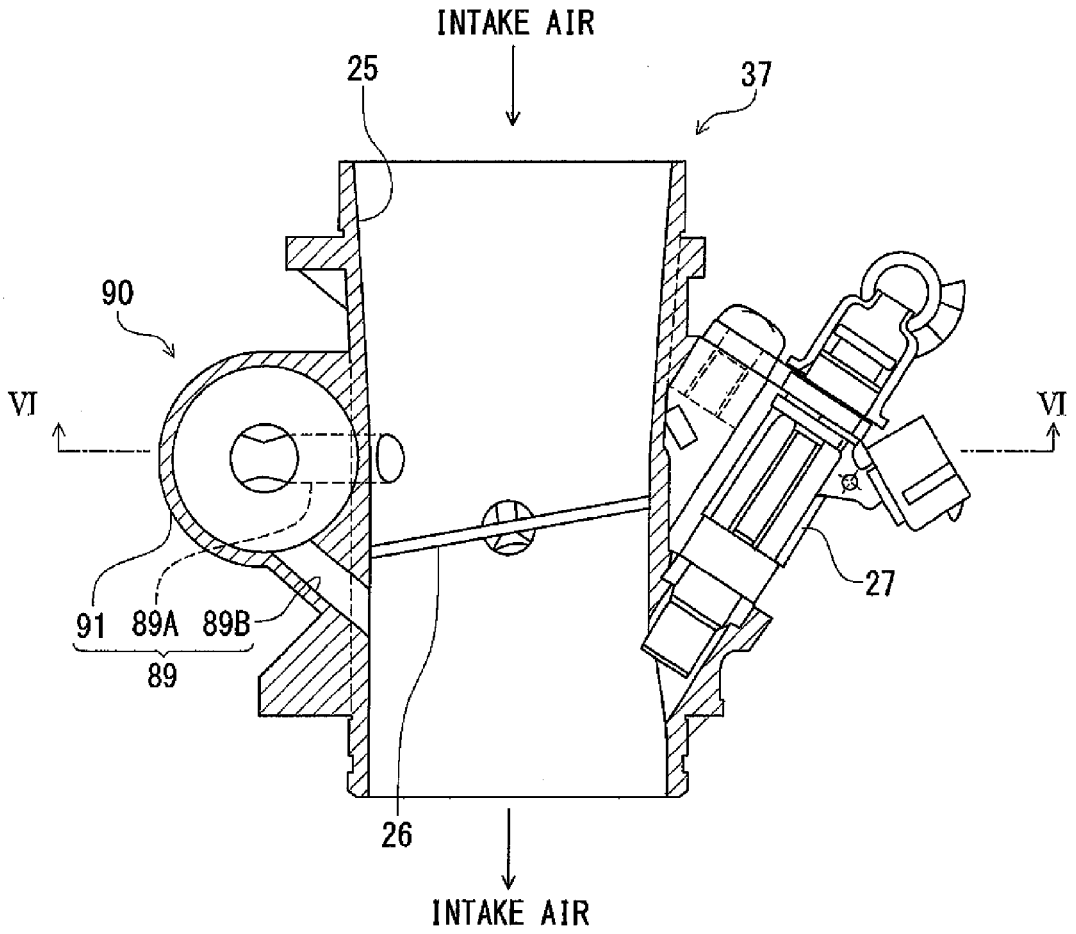
FIG. 5 is a sectional view of the throttle body in FIG. 2.

As shown in FIGS. 4 and 5, the throttle body 37 includes a throttle valve 26 that opens/closes an intake passage 25 formed inside of the throttle body 37. At a time of normal operation of the engine 28, the amount of air supplied to an intake port of the engine 28 is adjusted according to the degree of opening of the throttle valve 26. A fuel injector 27 is installed in the throttle body 37 for injecting fuel toward the intake port of the engine 28.

On the other hand, as shown in FIGS. 1 and 2, an exhaust device of the engine unit 14 is arranged on one side in the vehicle width direction (on the right side in the present embodiment) and below the upper pipes 3 of the vehicle body frame 2. The exhaust device is formed by an exhaust pipe 42 and an exhaust muffler 43. The exhaust pipe 42 extends forward from an exhaust port 44 (see FIG. 2) on the front surface of the cylinder head 34 and then curves to the right rear direction and extends backward, on the right side of the engine 28, substantially in parallel along and below the upper pipes 3 of the vehicle body frame 2, and has the exhaust muffler 43 connected to its lower side.

Further, as viewed from the side, the exhaust muffler 43 is arranged on the upper side of the rear wheels 12 and below the rear fender 24 (or the rear cover 23), for example.

Figure 3:
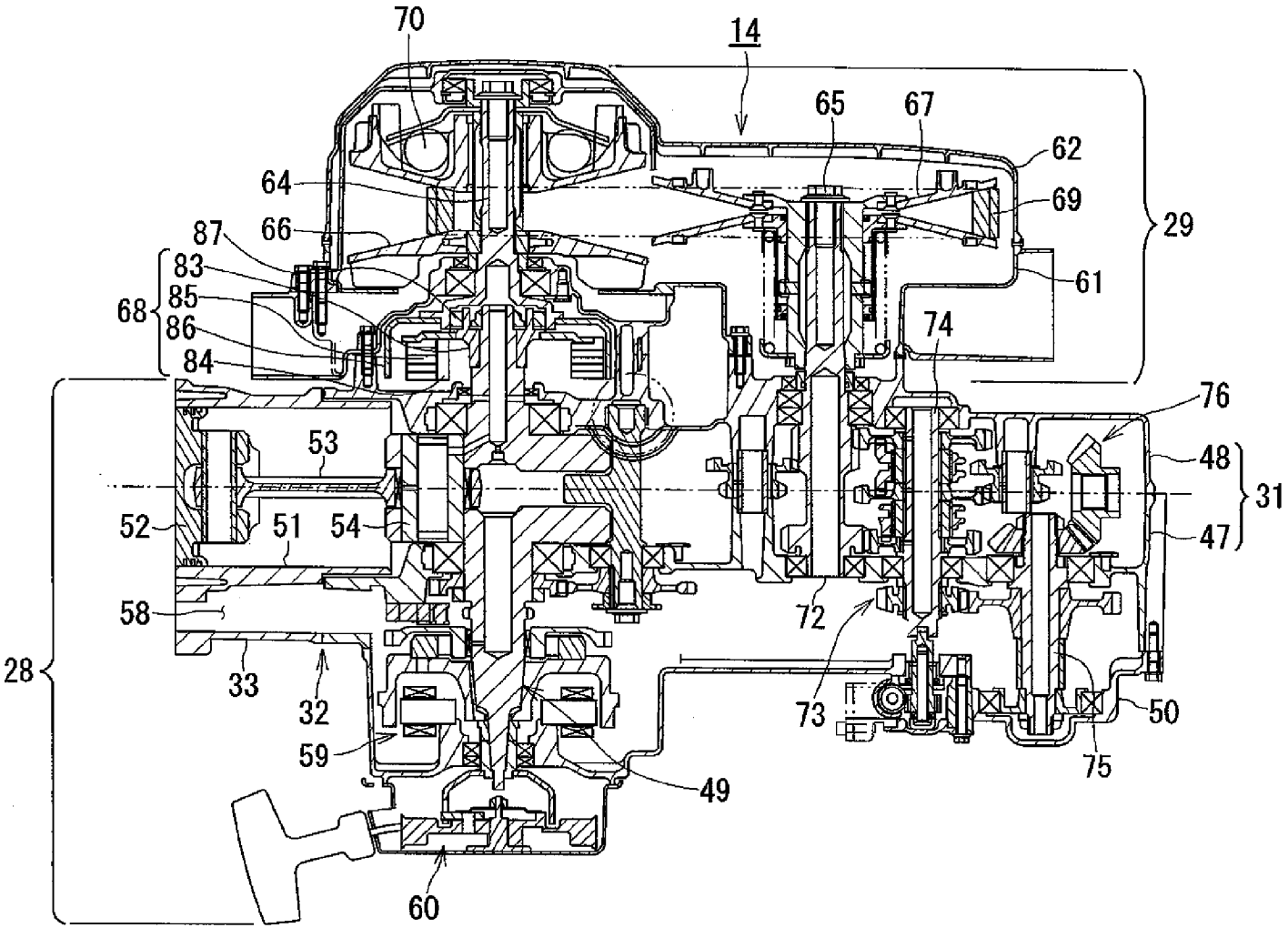
FIG. 3 is a sectional view of FIG. 2 taken along a line III-III.

FIG. 3 is a transverse sectional view of the engine unit 14, in an enlarged scale, taken along the line III-III in FIG. 2. The crankcase 31 forming the lower portion of the engine 28 is a left and right split type having a left case 47 and a right case 48 matched together, and a crankshaft 49 is arranged inside and toward the front of the crankcase 31 in parallel and oriented in the vehicle (vehicle body) width direction. Furthermore, a case cover 50 covers the left open surface of the left case 47.

A piston 52 is provided in a slidable manner within a cylinder bore 51 (a cylinder) formed in the cylinder block 33, and the piston 52 is coupled to a crankpin 54 of the crankshaft 49 via a connecting rod 53. The reciprocating motion of the piston 52 within the cylinder bore 51 is thereby converted to the rotational motion of the crankshaft 49 as an output of the engine 28.

In a plane view of the vehicle, a cam drive chamber 58 is provided on the left side of the cylinder assembly 32, and the transmission 29 is installed on the side opposite to the cam drive chamber 58 (on the right side) across the cylinder assembly 32. Further, in FIG. 3, reference sign 59 is a generator device for generating power, and reference sign 60 is a rope recoil starter device for starting the engine.

The transmission 29 is arranged in a space between a belt case 61 disposed on the right side of the crankcase 31, that is, on the right side of the right case 48, and a case cover 62 covering the right side of the belt case 61.

The transmission 29 includes a drive pulley shaft 64 arranged coaxially with and on the right of the crankshaft 49, a driven pulley shaft 65 arranged in parallel behind the drive pulley shaft 64, a drive pulley 66 journaled to the drive pulley shaft 64, a driven pulley 67 journaled to the driven pulley shaft 65, an automatic centrifugal clutch 68 provided between the drive pulley shaft 64 and the crankshaft 49, and a V-belt 69 wound between the drive pulley 66 and the driven pulley 67, for example.

When the engine 28 operates and the rotational speed of the crankshaft 49 reaches a predetermined value, the automatic centrifugal clutch 68 is connected and the drive pulley shaft 64 and the drive pulley 66 are rotated, and this rotation is transmitted to the driven pulley 67 and the driven pulley shaft 65 via the V-belt 69.

A weight roller 70 is embedded in the drive pulley 66, and the weight roller 70 extends in the centrifugal direction in accordance with the increase in the centrifugal force as the rotational speed of the drive pulley 66 increases. The face gap of the drive pulley 66 is thereby reduced and the effective pulley diameter is increased, and the face gap of the driven pulley 67 is increased, and the effective pulley diameter is reduced, thereby continuously changing the rotation (acceleration).

The rotation of the driven pulley shaft 65 is transmitted to a transmission countershaft 72 joined coaxially to be rotated together. The rotation of the transmission countershaft 72 is transmitted to a transmission drive shaft 74 via a transmission gear device 73 with a plurality of stages, and is then transmitted to a propeller shaft 78 for driving the front wheel and a propeller shaft 79 for driving the rear wheel shown in FIG. 1, via a bevel gear shaft 75 and a bevel gear device 76.

The propeller shaft 78 for driving the front wheel and the propeller shaft 79 for driving rear wheel extend in a longitudinal direction of the vehicle substantially horizontally along the centerline in the vehicle width direction of the all terrain vehicle 1, and a front wheel differential device 81 and a rear wheel differential device 82 are joined to the front end and the rear end of the propeller shafts. Furthermore, the front wheels 11 and the rear wheels 12 are joined to a pair of left and right axle shafts, not illustrated, extending from the front wheel differential device 81 and the rear wheel differential device 82 in the vehicle width direction.

As described above, the output of the engine 28 (the rotating motion of the crankshaft 49) undergoes a continuous speed change by the transmission 29 via the automatic centrifugal clutch 68, and then, is transmitted to the front wheels 11 and the rear wheels 12 via the propeller shaft 78 for driving the front wheel, the propeller shaft 79 for driving the rear wheel and the like.

As shown in FIG. 3, the automatic centrifugal clutch 68 includes a clutch hub 83 that is attached at a shaft end of the crankshaft 49 so as to rotate together, a clutch shoe 85 that is attached to the clutch hub 83 via a rocker shaft 84, and a clutch housing 86 that is rotated when engaged with the clutch shoe 85 due to the centrifugal force acting on the clutch shoe 85.

The clutch housing 86 is provided so as to rotate together with the drive pulley shaft 64 so as to be able to transmit the rotation of the crankshaft 49 to the drive pulley shaft 64 via the clutch shoe 85 and the clutch hub 83. Further, the clutch housing 86 is joined with the clutch hub 83 via a one way clutch 87. This one way clutch 87 is configured so as not to transmit the rotation of the crankshaft 49 to the clutch housing 86 with respect to an input from the clutch hub 83, but to transmit the rotation to the clutch hub 83 with respect to an input from the clutch housing 86.

When the throttle valve 26 (FIG. 5) is opened and the engine speed is increased from the idling state of the engine 28, and the clutch shoe 85 of the automatic centrifugal clutch 68 flares due to the centrifugal force and engages with the clutch housing 86, the rotation of the crankshaft 49 is transmitted to the drive pulley shaft 64 via the clutch hub 83, the clutch shoe 85 and the clutch housing 86.

On the other hand, at the time of deceleration, such as when completely closing the throttle valve 26 from the driving state, the engine speed is reduced to the idle speed and the centrifugal force acting on the clutch shoe 85 falls below a set value, and thus, the automatic centrifugal clutch 68 is disengaged. However, back torque from the drive pulley shaft 64 is transmitted from the clutch housing 86 to the clutch hub 83 via the one way clutch 87 and then to the crankshaft 49, causing the engine brake to act.

Figure 6:
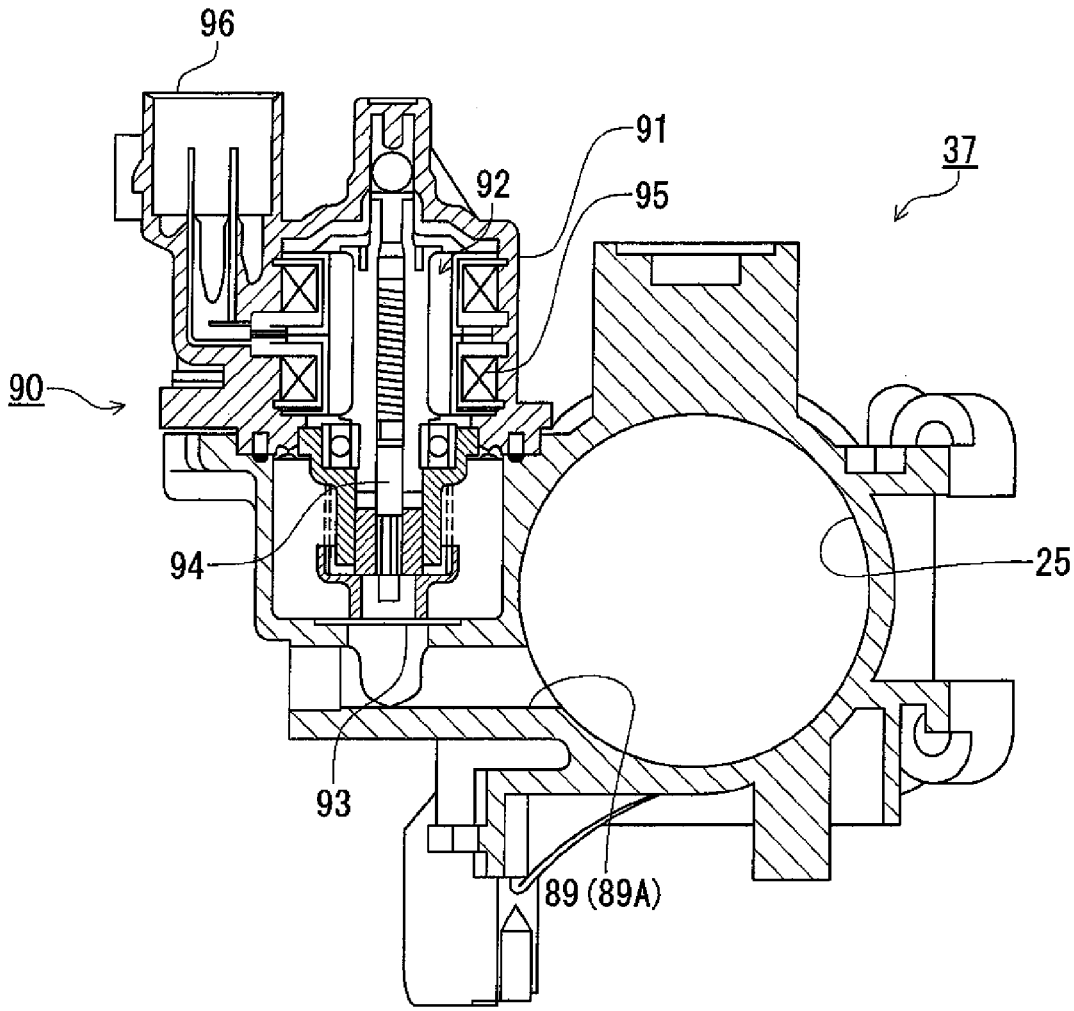
FIG. 6 is a sectional view of FIGS. 4 and 5 along a line VI-VI.

Incidentally, as shown in FIGS. 4 to 6, the engine 28 shown in FIG. 2 includes an intake bypass passage 89 and an ISC (Idle Speed Control) device 90 to control the engine speed at the time of idling (the idle speed) to a target speed. These intake bypass passage 89 and ISC device 90 are provided in the throttle body 37.

That is, as shown in FIG. 5, the intake bypass passage 89 is formed to have an upper port 89A on the upper side, and a lower port 89B on the lower side, of the throttle valve 26 disposed in the intake passage 25 of the throttle body 37, each communicating with the throttle body 37 through the inside of a housing 91 of the ISC device 90. The upper side and the lower side of the throttle valve 26 in the intake passage 25 are connected by the intake bypass passage 89.

The ISC device 90 is constructed and disposed in the intake bypass passage 89 with an ISC valve 92 being accommodated within the housing 91. The ISC valve 92 adjusts the degree of opening by driving a valve stem 94 having a valve disc 93 at the tip end, for example, by a stepping motor 95. When a control unit 104 described later adjusts the degree of opening of the ISC valve 92 at the time of idling of the engine 28, the amount of air flowing through the intake bypass passage 89 at the time of idling is adjusted, and the idle speed of the engine 28 is controlled to be a target speed. Further, in FIG. 6, reference sign 96 is a connector that connects to a harness for transmitting a drive signal from the control unit 104 to the stepping motor 95.

Incidentally, as shown in FIG. 2, the all terrain vehicle 1 of the present embodiment includes an engine control device 100 (FIG. 7) for controlling the engine 28 so as to prevent the vehicle from moving by the connection of the automatic centrifugal clutch 68 (FIG. 3) due to an excessive increase in the engine speed at the time of idling because of fixation of the ISC valve 92 of the ISC device 90 in an open state by carbon deposit or the like.

The engine control device 100 is configured to include a crank angle sensor 101, an intake pressure sensor 102, a throttle opening degree sensor 103, and the control unit 104.

Figure 7:
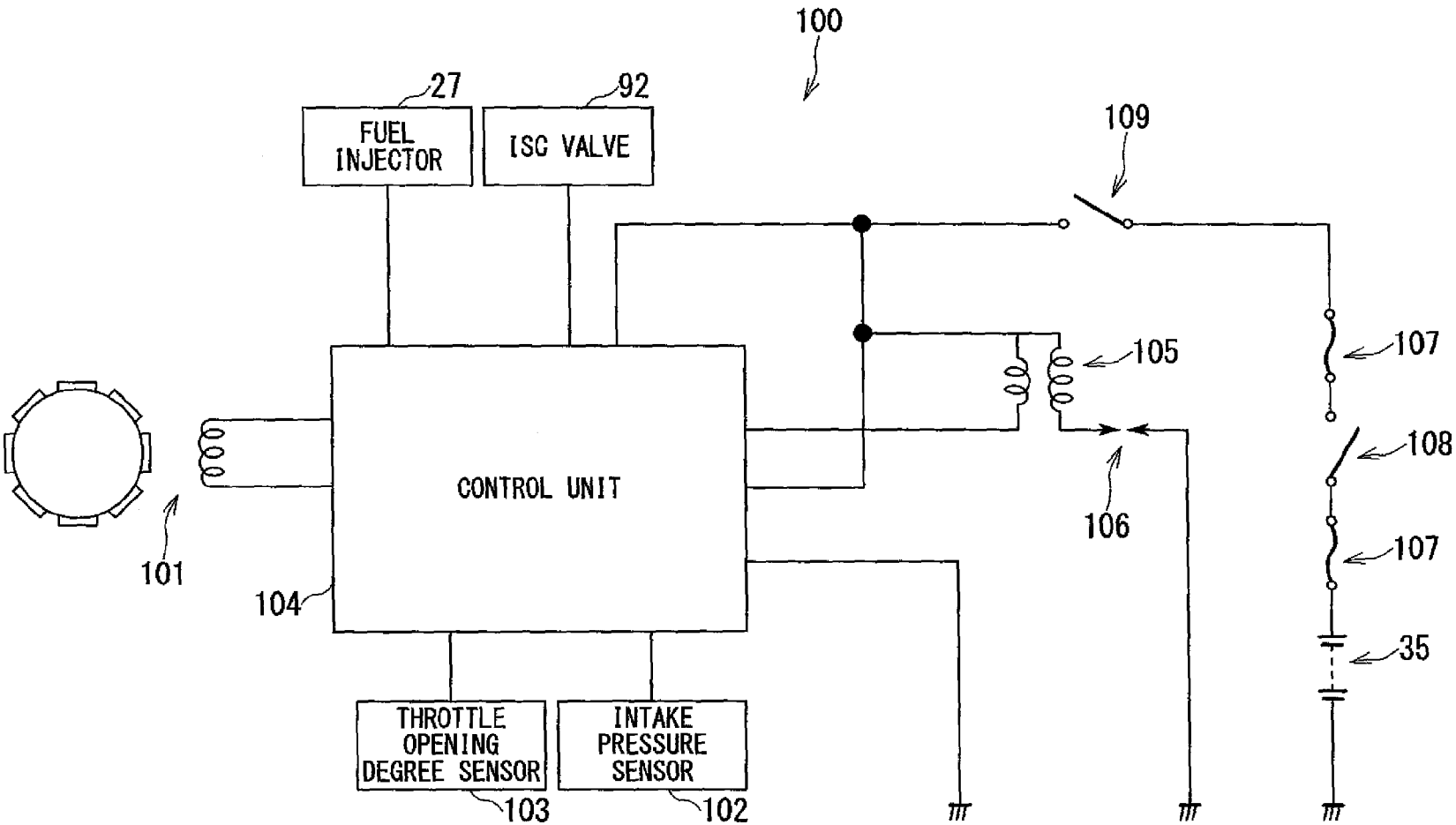
FIG. 7 is a block diagram showing an engine control device including a control unit and the like in FIG. 2.

As shown in FIGS. 7 and 2, the crank angle sensor 101 is installed in the crankcase 31 and operates as an engine speed sensor that detects the speed of the engine 28 by detecting the rotational angle of the crankshaft 49. Furthermore, as shown in FIGS. 7 and 4, the intake pressure sensor 102 is attached integrally or as a separate body to the throttle body 37, and detects the negative pressure of intake air (the intake negative pressure) taken into the intake port of the engine 28 at the lower side of the throttle valve 26 in the intake passage 25 of the throttle body 37.

The throttle opening degree sensor 103 is attached to an end portion of a throttle valve shaft 30 to which the throttle valve 26 is attached, and detects the degree of opening of the throttle valve 26.

As shown in FIG. 7, power (electric power) is supplied to the control unit 104 and an ignition coil 105 from the battery 35 via fuses 107, an ignition switch 108 and an engine stop switch 109. As shown in FIG. 2, the control unit 104 is mounted on the upper pipe 3, in front of the fuel tank 17 and behind the battery 35. Moreover, the ignition coil 105 is disposed near a connection portion of the front vertical pipe 7 to the upper pipe 3.

As shown in FIG. 7, the control unit 104 performs controlling of the engine 28, as basic controls, such as a fuel injection control for controlling the fuel injector 27, an ignition control for outputting an ignition signal to the ignition coil 105 and controlling ignition of an ignition plug 106, an idle speed control for controlling the degree of opening of the ISC valve 92, and the like, and also, performs an engine output suppression control as an idle overspeed prevention control based on each detected value of the crank angle sensor 101, the intake pressure sensor 102 and the throttle opening degree sensor 103.

With this engine output suppression control, the control unit 104 determines that an abnormality, such as fixation of the ISC valve 92 of the ISC device 90 in an open state, for example, has occurred, in the case where the degree of opening of the throttle valve 26 detected by the throttle opening degree sensor 103 is within a predetermined range indicating a completely closed region (specifically, a completely closed state or a substantially, completely closed state where the degree of opening is about 1% or less) and when the intake negative pressure detected by the intake pressure sensor 102 is below a threshold value when compared with the threshold value, and then, in such case, the control unit 104 suppresses the output of the engine 28.

That is, as will be described in detail later, the control unit 104 compares an intake negative pressure being detected by the intake pressure sensor 102 with the threshold value, the intake negative pressure detected in the case where the degree of opening of the throttle valve 26 detected by the throttle opening degree sensor 103 is within the predetermined range indicating the completely closed region described above and when the engine speed is at a predetermined value or higher after an increase in the engine speed by a predetermined amount or more is detected within a predetermined time. If the intake negative pressure is below the threshold value, the control unit 104 determines that an abnormality, such as fixation of the ISC valve 92 of the ISC device 90 in an open state, has occurred.

In the above steps, the step of detecting whether or not there is an increase in the engine speed by the predetermined amount or more within the predetermined time is the step of sequentially performing a first engine speed increase determination step of determining the amount of increase in the engine speed within a first predetermined time $\Delta t1$ which is an extremely infinitesimal duration, and a second engine speed increase determination step of detecting the amount of increase in the engine speed within a second predetermined time $\Delta t2$ which is longer than the first predetermined time $\Delta t1$.

Furthermore, the predetermined value of the engine speed mentioned above is set to be greater than the idle speed of the engine 28 when the ISC valve 92 is normal (for example, 1500 rpm), and less than the engine speed when the automatic centrifugal clutch 68 is engaged (for example, 1900 rpm).

When the intake negative pressure detected by the intake pressure sensor 102 is detected to be below the threshold value, the control unit 104 determines that the ISC valve 92 of the ISC device 90 is abnormal, and when a specific time has elapsed after the determination of the abnormality, the control unit 104 performs a control of suppressing the output of the engine 28.

In the present embodiment, this output suppression control is an ignition thinning out control of carrying out only the ignition of a given cycle (for example, one cycle) among a plurality of successive cycles of the engine 28 and cutting out (thinning out) the ignition of other cycles. Further, one cycle of the engine 28 includes an expansion stroke, an exhaust stroke, an intake stroke and a compression stroke that are sequentially performed.

The abnormality determination control for the ISC valve 92 and the output suppression control (idle overspeed prevention control) for the engine 28 performed by the control unit 104 will be described in detail with reference to the flow charts of FIGS. 8 and 9, for example.

Figure 8:
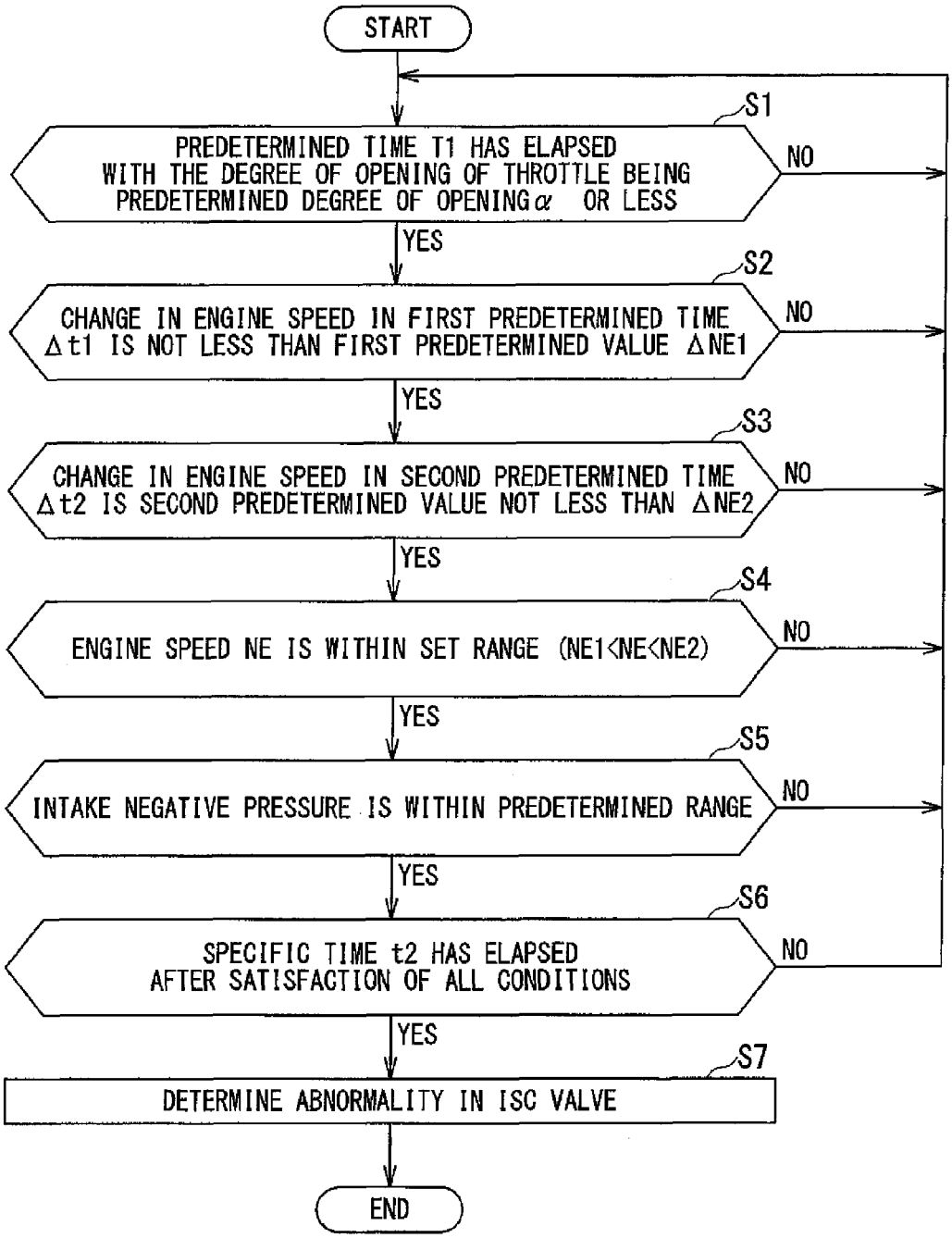
FIG. 8 is a flow chart explaining an ISC valve abnormality determination control performed by the control unit in FIG. 7.

(A) Abnormality Determination Control for ISC Valve 92 (FIG. 8)

The control unit 104 first determines whether or not a state where the degree of opening of the throttle valve 26 is a predetermined degree of opening α (for example, the degree of opening of 1%) or less has continued for a predetermined time T1 (for example, 320 msec) or longer (step S1). Herein, whether or not the degree of opening of the throttle valve 26 is within a predetermined range indicating a completely closed region (specifically, a completely closed state or a substantially, completely closed state where the degree of opening is about 1% or less) is determined, and instantaneous complete closing or substantially complete closing of the throttle valve 26 is excluded by allowing the condition to be satisfied in the case of continuance over the predetermined time T1 or longer. Complete closing or substantially complete closing of the throttle valve 26 over a short time is an operation that may be normally performed while the vehicle is travelling, and since the effect of fixation of the ISC valve 92 is hardly felt because it is during travelling, the engine output suppression control does not have to be performed.

The control unit 104 next determines whether or not a change in the engine speed in the first predetermined time Δt1 (for example, 40 ms) is a first predetermined value ΔNE1 (for example, 40 rpm) or higher (steps S2). This step S2 is a step of determining whether or not the engine speed indicates a degree of increase of a predetermined level or higher in spite of the degree of opening of the throttle valve 26 being within the predetermined range indicating the completely closed region described above (the first engine speed increase determination step).

The control unit 104 next determines whether or not a change in the engine speed in the second predetermined time Δt2 (for example, 200 ms) is a second predetermined value ΔNE2 (for example, 150 rpm) or higher (step S3). This step S3 is a step of determining the degree of increase in the engine speed in a time longer than that in Step S2 in a state where the degree of opening of the throttle valve 26 is within the predetermined range indicating the completely closed region described above by making Δt2 greater than Δt1 and ΔNE2 greater than ΔNE1 (the second engine speed increase determination step).

Figure 10:
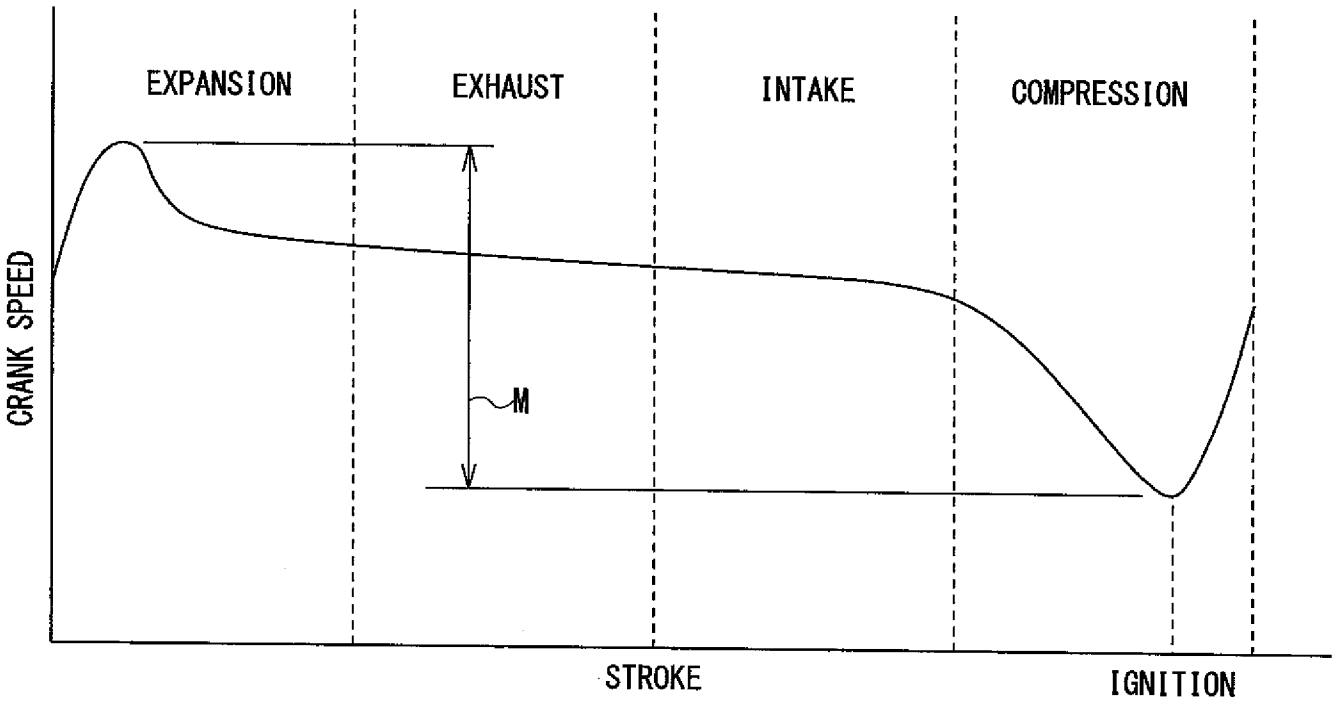
FIG. 10 is a graph representing a change in a crank speed of an engine shown in FIG. 2.

As shown in FIG. 10, with a single cylinder engine 28 of a large displacement (750 cc, 500 cc or the like), which is often mounted in the all terrain vehicle 1 of the present embodiment, since a change M in the crank speed (piston speed) in one cycle is great, if only step S2 is performed, there is a possibility that a drastic increase in the crank speed near the compression top dead point immediately after explosion is detected and erroneously determined as the increase in the engine speed. This erroneous determination may be avoided by adding the step S3.

The control unit 104 next determines whether or not the engine speed NE is within a set range where it should be controlled (NE1<NE<NE2: for example, NE1=1675 rpm, NE2=12000 rpm) (step S4). The set speed NE1 may be set appropriately to an engine speed before the automatic centrifugal clutch 68 is engaged. Furthermore, the set engine speed NE2 may be a lower limit value as a rev limit for cutting off fuel injection. This is because the engine output suppression control is already performed during this fuel injection cutoff and the engine output suppression control (the ignition thinning out control in the present embodiment) at the time of abnormality in the ISC valve 92 becomes unnecessary in a rotation region of the set speed NE2 or greater. Further, in the present embodiment, the speed (clutch-in speed) at which the automatic centrifugal clutch 68 starts to be engaged engage is 1900 rpm.

The control unit 104 next determines whether or not the current engine speed and the intake negative pressure are within a range of a predetermined intake negative pressure for that speed (step S5). Here, the range of the predetermined intake negative pressure is decided based on an intake negative pressure value (a function, a table or the like) as a threshold value that changes with the engine speed as a variable. Specifically, based on an engine speed-intake negative pressure map as shown in FIG. 11, for example, the curved line A in FIG. 11 is taken as the threshold, and a range where the intake negative pressure is smaller (lower) than the curved line A is taken as the range of the predetermined intake negative pressure.

Figure 11:
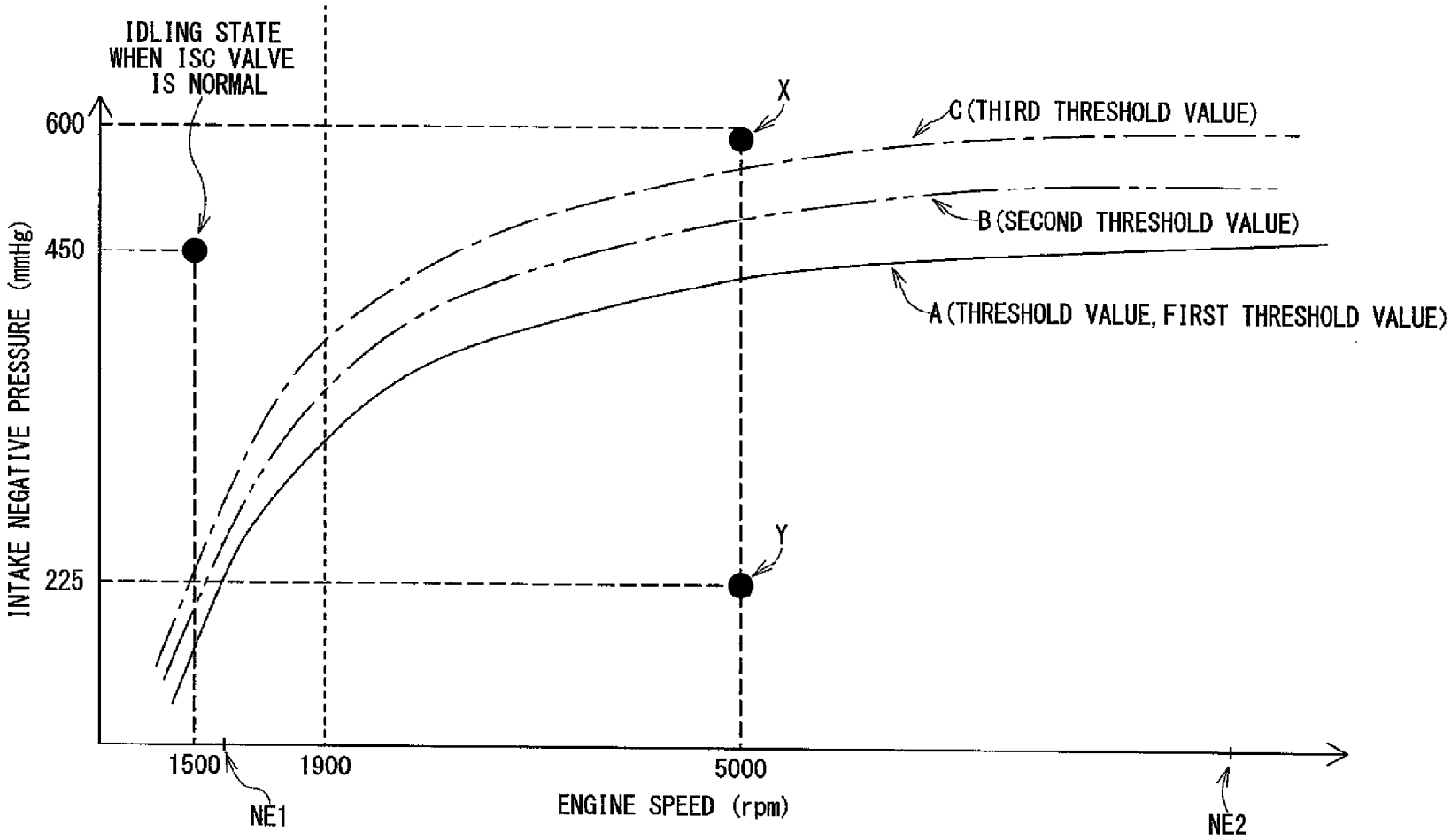
FIG. 11 is a graph used for judging or determining implementation of the idle overspeed prevention control based on an intake negative pressure.

In the present embodiment, since it is confirmed that a parked vehicle whose throttle valve 26 is completely closed starts moving when the ISC valve 92 is fixed with the degree of opening of 75%, the curved line A showing a relationship between the engine speed and the intake negative pressure for a case where the degree of opening of the ISC valve 92 is fixed at 75% is shown in FIG. 11 as the threshold value. If the current engine speed and the intake negative pressure are in a region where the intake negative pressure is greater (higher) than the curved line A in FIG. 11 (for example, at point X in FIG. 11), the control unit 104 determines that the ISC valve 92 is fixed at a low degree of opening which is a normal level or a level allowed to be overlooked, and in contrast, when they are in a region where the intake negative pressure is smaller (lower) than the curved line A (for example, at point Y in FIG. 11), the control unit 104 determines that the ISC valve 92 is fixed at a high degree of opening which is an abnormal level or a level not allowed to be overlooked. This is because the pumping loss becomes less and the intake negative pressure becomes lower as the area of opening of the intake bypass passage 89 becomes greater, thereby increasing the amount of air flowing through the intake bypass passage 89, which results in the increase in the engine speed.

The control unit 104 next determines whether or not a specific time T2 has elapsed since the determination result of step S5 became YES (step S6). This is to check that the lowering of the intake negative pressure is not instantaneous, and in the present embodiment, the specific time T2 is 40 msec or longer.

Figure 9:
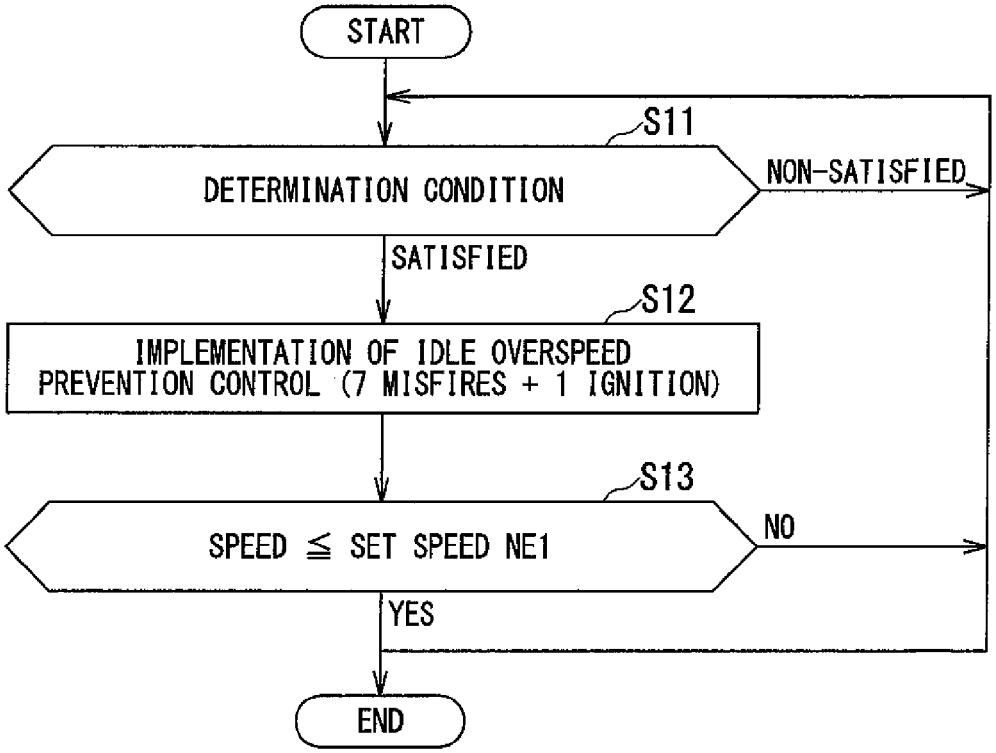
FIG. 9 is a flow chart explaining idle overspeed prevention control performed by the control unit in FIG. 7.

When the determination result of step S6 is YES, the control unit 104 determines that the ISC valve 92 is abnormal (step S7), and then, performs the idle overspeed prevention control (the so-called engine output suppression control) shown in FIG. 9.

(B) Output Suppression Control for Engine 28 (FIG. 9)

Figure 12:
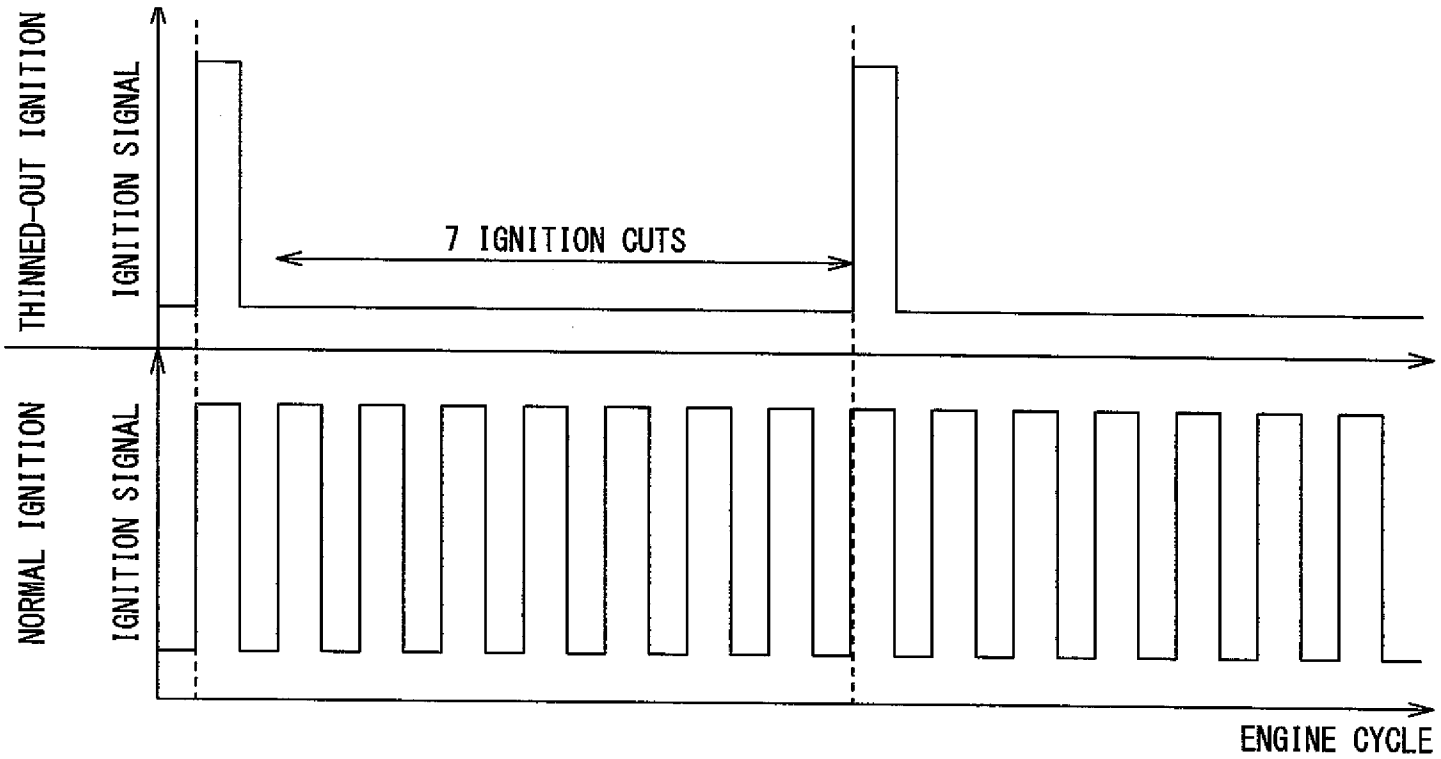
FIG. 12 is a timing chart showing thinned-out ignition in comparison with normal ignition.

When an abnormality in the ISC valve 92 is determined in step S11 (that is, step S7 in FIG. 8), the control unit 104 proceeds to step S12 assuming that a determination condition is satisfied. Specifically, the idle overspeed prevention control (the engine output suppression control) of step S12 is the ignition thinning out control where, as shown in FIG. 12, the control unit 104 controls an ignition signal to be output to the ignition coil 105, causes the ignition to be misfired for successive seven cycles of the engine 28, and causes the ignition to happen only one time in the next cycle at a normal ignition timing.

Figure 13:
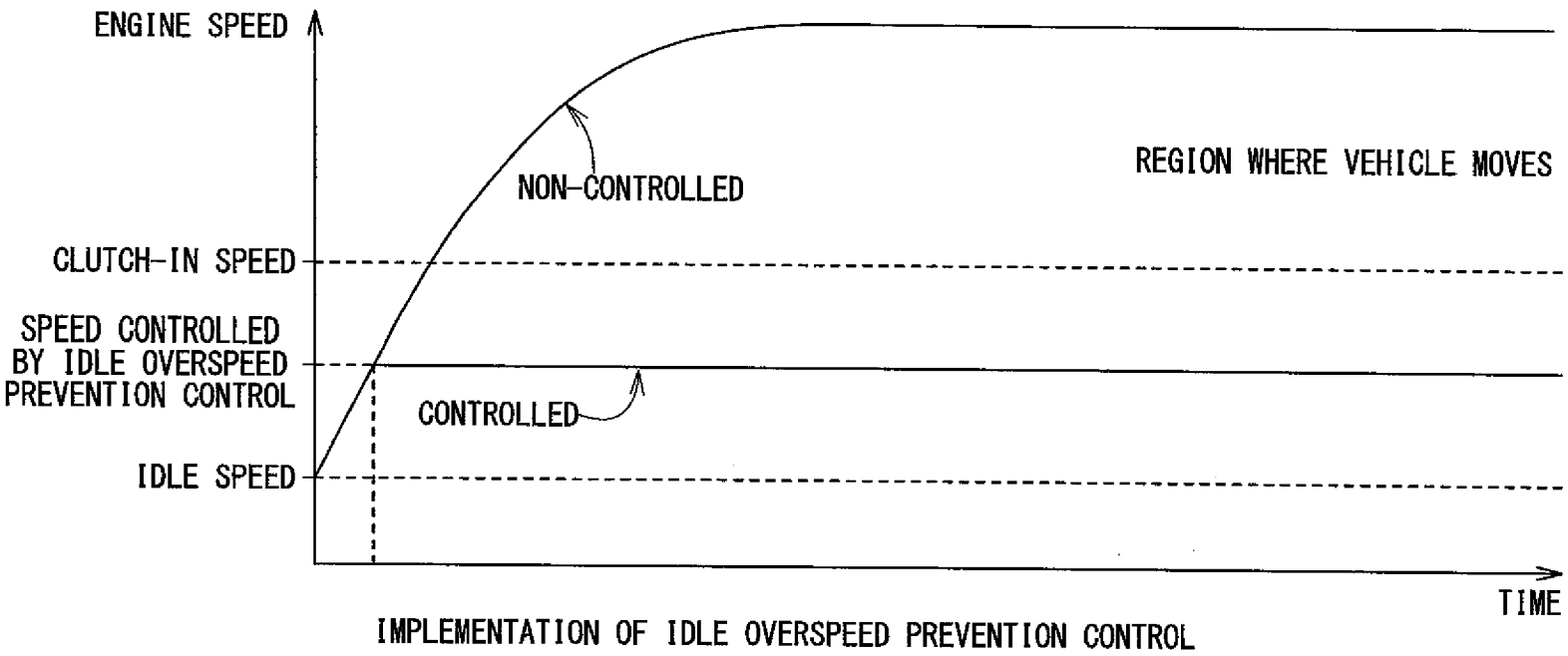
FIG. 13 is a graph representing a change in an engine speed between a case where the idle overspeed prevention control is performed and a case of not being performed.

The control unit 104 next determines whether or not the engine speed is at the set speed NE1 (for example, 1675 rpm) or less as a result of step S12 (step S13). When YES is determined in this step S13, the control unit 104 ends the idle overspeed prevention control (the ignition thinning out control). Due to the idle overspeed prevention control, the increase in the engine speed is suppressed as shown in FIG. 13 and the engine speed is restricted to below the clutch-in speed (for example, 1900 rpm) at which the vehicle starts moving, and thus, an abrupt start not expected by the rider can be definitely prevented.

With the operation and configuration mentioned above, the following effect (1) will be achieved by the present embodiment.

(1) The ISC valve 92 of the ISC device 90 is determined to be abnormal in the case where the degree of opening of the throttle valve 26 detected by the throttle opening degree sensor 103 is within a predetermined range indicating a completely closed region (specifically, a completely closed state or a substantially, completely closed state where the degree of opening is about 1% or less), and when the intake negative pressure detected by the intake pressure sensor 102 is below a threshold value, and an engine output suppression control for suppressing the output of the engine 28 (for example, the ignition thinning out control) is performed.

Accordingly, an excessive increase in the engine speed can be prevented even in a case where the amount of intake air supplied to the engine 28 is not reduced at the time of an abnormality such as fixation of the ISC valve 92 in an open state in spite of the throttle valve 26 being within the predetermined range indicating the completely closed region described above. Thus, if the engine speed is suppressed to below the clutch-in speed, a situation where the vehicle unexpectedly starts at the time of idling of the engine 28 can be prevented.

Additionally, in the first embodiment, the threshold value of the intake negative pressure shows only the relationship between the engine speed and the intake negative pressure for a case where the ISC valve 92 is fixed at the degree of opening of 75% (the curved line A in FIG. 11), but a plurality of types (for example, the degree of opening of 75%, the degree of opening of 50%, the degree of opening of 30%) may be prepared according to the degree of opening of the ISC valve 92 at the time of fixation of the ISC valve 92. For example, the relationships between the engine speed and the intake negative pressure for cases where the ISC valve 92 is fixed at 75%, 50% and 30% may be set as a first threshold value (curved line A in FIG. 11), a second threshold value (curved line B in FIG. 11) and a third threshold value (curved line C in FIG. 11), respectively.

Figure 14:
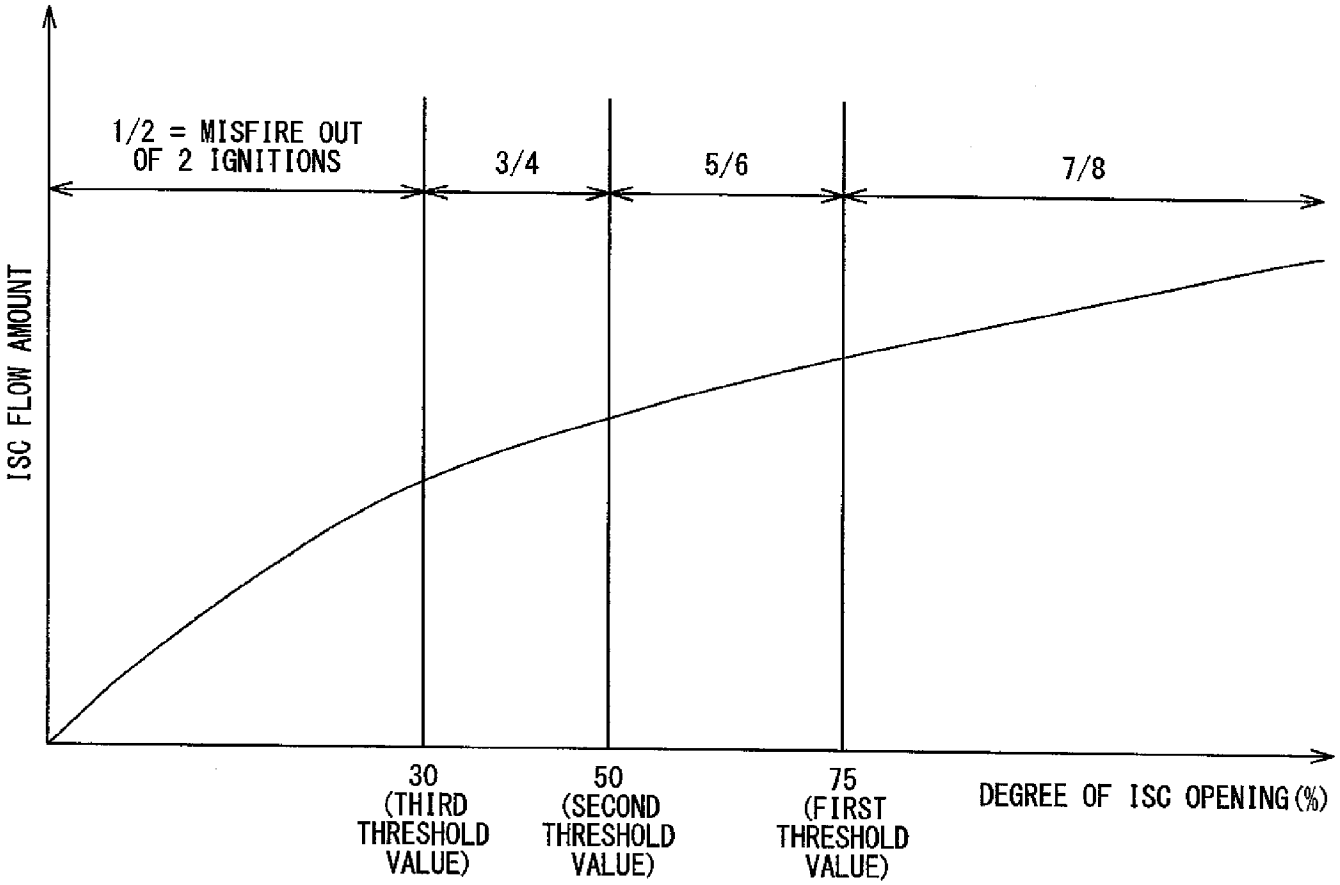
FIG. 14 is a graph representing a relationship between the degree of opening of an ISC valve (ISC opening degree), the amount of air flowing through an intake bypass passage (ISC flow amount) and the proportion of ignition thinning.

In this case, the control unit 104 may cause the engine output suppression control (the idle overspeed prevention control) to be different according to each threshold value. That is, as shown in FIG. 14, for example, the amount of air flowing through the intake bypass passage 89 (ISC flow amount) is increased as the degree of opening of the ISC valve 92 (ISC opening degree) is greater. Thus, as shown in FIGS. 11 and 14, the control unit 104 causes misfires in seven cycles out of eight cycles of the engine 28 in the case where the intake negative pressure at a given engine speed within a set range (step S4 in FIG. 8) is at the first threshold value or less, in five cycles out of six cycles of the engine 28 in the case where the intake negative pressure exceeds the first threshold value and is at the second threshold value or less, in three cycles out of four cycles of the engine 28 in the case where the intake negative pressure exceeds the second threshold value and is at the third threshold value or less, and in one cycle out of two cycles of the engine 28 in the case where the intake negative pressure exceeds the third threshold value. In this manner, an ignition thinning out control where the proportion of thinned-out ignitions is changed according to the expected degree of opening of the fixed ISC valve 92 may also be performed.

[II] Second Embodiment

Figure 15:
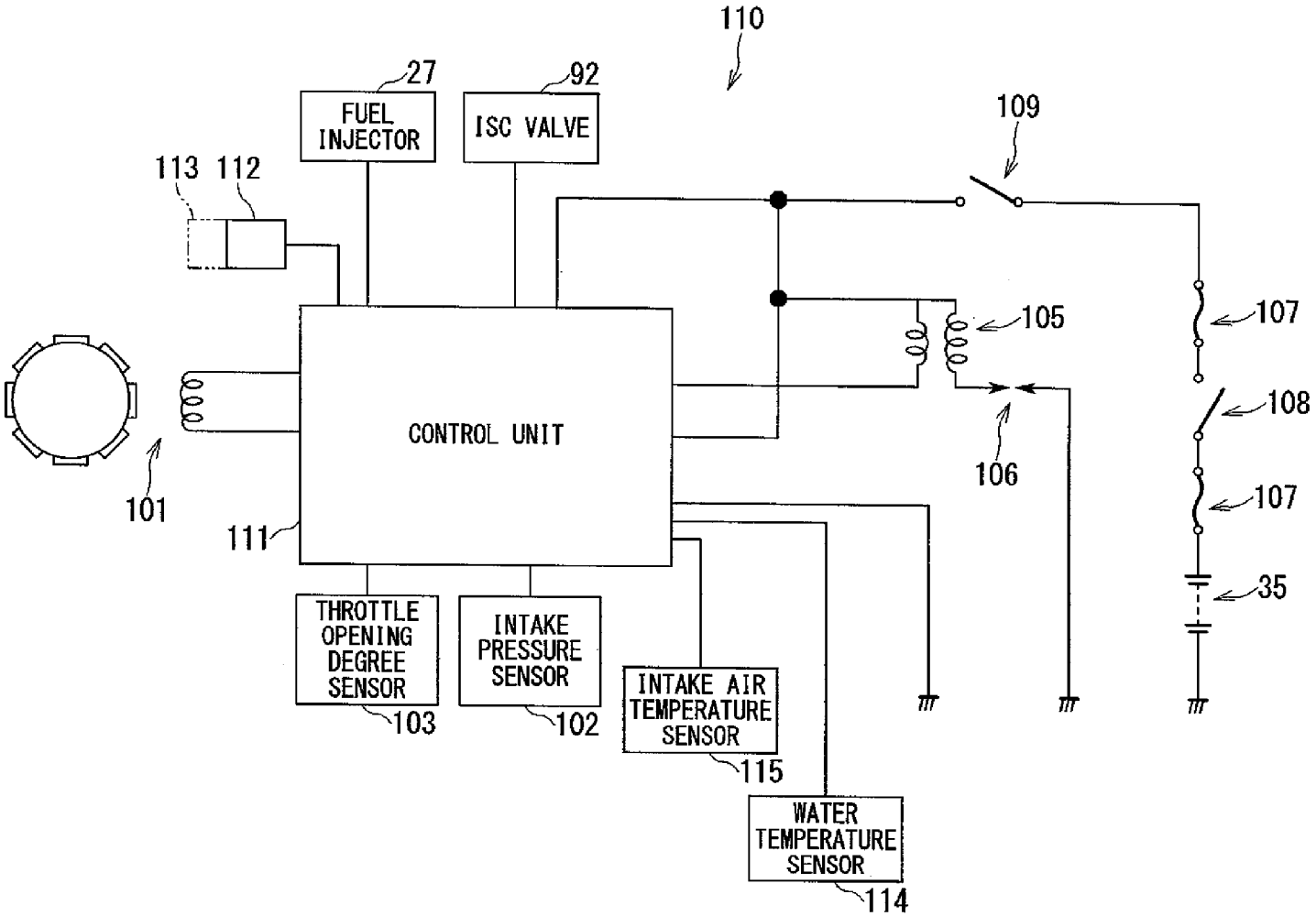
FIG. 15 is a block diagram representing a second embodiment of the engine control device according to the present invention.
Figure 16:
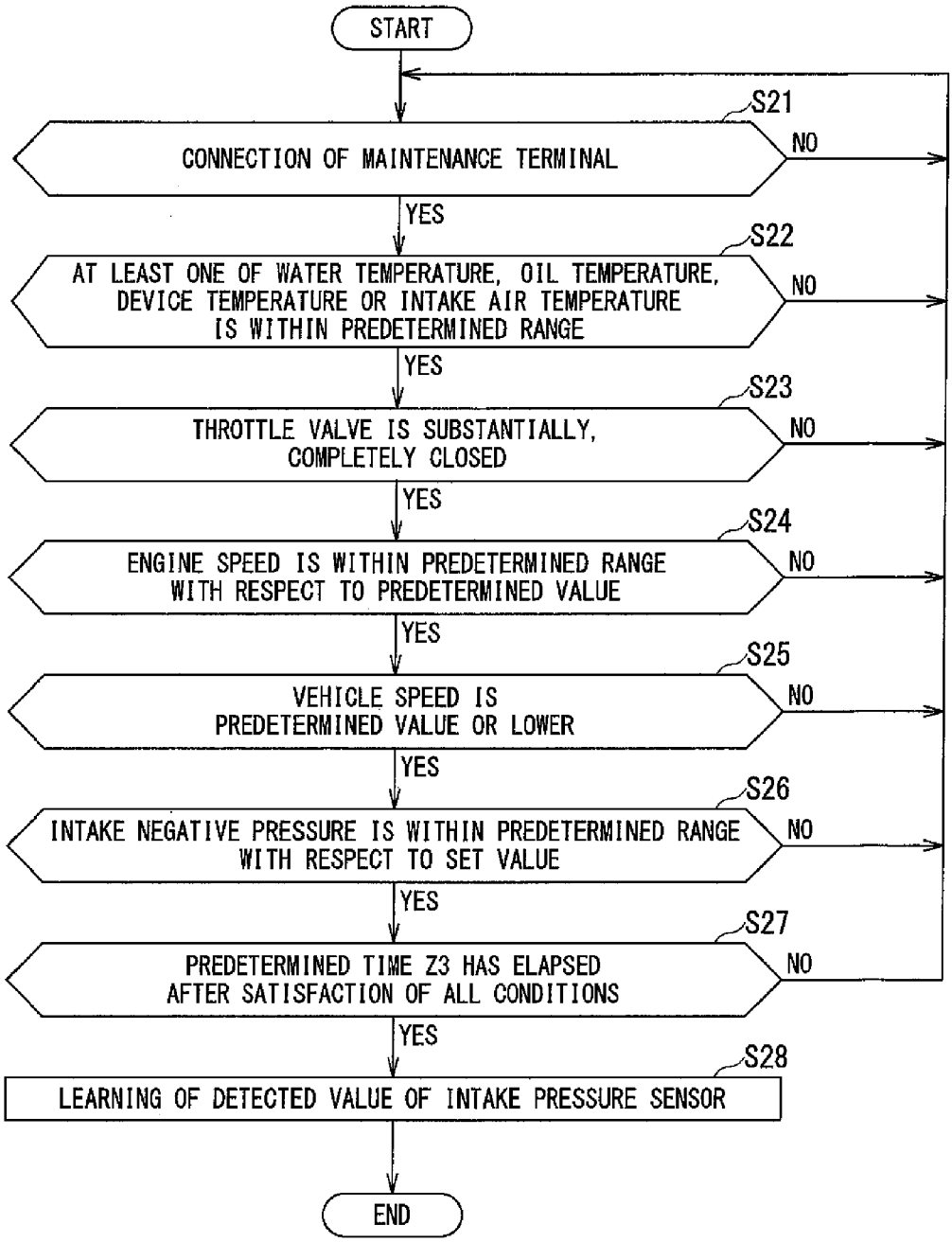
FIG. 16 is a flow chart explaining an intake pressure sensor learning control performed by a control unit in FIG. 15.

FIGS. 2, 15 and 16

FIG. 15 is a block diagram showing a second embodiment of the engine control device according to the present invention, and FIG. 16 is a flow chart showing an intake pressure sensor learning control performed by a control unit in FIG. 15. In the second embodiment, portions or members same as those of the first embodiment described above will be denoted with the same reference signs, and explanation thereof will be simplified or omitted.

Similarly to the control unit 104 of the engine control device 100 of the first embodiment described above, a control unit 111 of an engine control device 110 of the second embodiment performs basic controls such as a fuel injection control, an ignition control, an idle speed control and the like, and an engine output suppression control (the abnormality determination control for the ISC valve 92 and the idle overspeed prevention control), and also performs an intake pressure sensor learning control.

This intake pressure sensor learning control is performed to learn so as to correct a detected value of the intake negative pressure detected by the intake pressure sensor 102 shown in FIGS. 2, 4 and 15 and to eliminate the influence of individual differences or deterioration in elapsed time of the intake pressure sensors 102 installed in respective all terrain vehicles 1. The value of the intake negative pressure which has been learned is used as the value of the intake negative pressure of step S5 (FIG. 8) of the abnormality determination control for the ISC valve 92.

That is, when a predetermined condition is satisfied, the control unit 111 grasps the property of the intake pressure sensor 102 (the amount of change 8 of the detected value described later) based on the detected value of the intake negative pressure detected by the intake pressure sensor 102 in a predetermined operation state, and performs, as shown in FIG. 16, the intake pressure sensor learning control of performing learning so as to correct the detected value of the intake negative pressure subsequently detected by the intake pressure sensor 102 based on the property mentioned above.

First, the control unit 111 determines whether or not a predetermined condition is satisfied, that is, whether or not the all terrain vehicle 1, on which the engine 28 is mounted, is in a maintenance state (step S21).

As shown in FIGS. 2 and 15, the control unit 111 includes an existing maintenance terminal 112 for plugging in a special tool 113 (for example, a tool for reading error code or a tool for short circuit) that is used at the time of maintenance of the all terrain vehicle 1. The control unit 111 recognizes that the all terrain vehicle 1 is in a maintenance state by detecting, for over a predetermined time Z1 or longer (for example, five seconds), that the special tool 113 has been connected to the maintenance terminal 112 and the maintenance terminal 112 has fallen in a connected state (a conducted state in a case where the special tool 113 is the tool of reading error code, and a shorted state in a case where the special tool 113 is the tool for short circuit). This is to perform the intake pressure sensor learning control of the present embodiment at the time of maintenance of the all terrain vehicle 1.

Then, as shown in FIG. 16, when determining in step S21 that the maintenance terminal 112 is in the connected state, and that the all terrain vehicle 1 is in the maintenance state, the control unit 111 determines whether or not the engine 28 (FIG. 2) is in a predetermined engine operation state (step S22 to step S27).

This predetermined operation state refers to a state where all of the following are satisfied: that an indicator indicating a warm-up state of the engine 28 indicates that the engine 28 is in a warmed-up state (step S22), that the throttle valve 26 (FIG. 5) is in a substantially, completely closed state (step S23), that the engine speed is in a stable idling state (step S24), that the vehicle speed of the all terrain vehicle 1 is at a predetermined value or lower (step S25), that the intake negative pressure is within a predetermined range with respect to a set value for the idling of the engine 28 (step S26), and that each of the states described above has been continuing for a predetermined time Z3 (step S27).

The indicator indicating the warm-up state of the engine 28 (FIG. 2) in step S22 is at least one, preferably two or more, of the temperature of water flowing inside a water jacket formed in the cylinder block 33 of the engine 28 (water temperature), oil temperature of lubricating oil for lubricating each portion of the engine 28, the temperature of an outer wall of the cylinder block 33 of the engine 28 (device temperature), and the temperature of intake air at a lower part within the air cleaner 39 (intake air temperature).

As shown in FIGS. 2 and 15, in the second embodiment, the control unit 111 determines that the engine 28 is in a warmed-up state by confirming that the water temperature detected by a water temperature 114 installed in the cylinder block 33 of the engine 28 is at a set value (for example, 70° C.) or higher and the intake air temperature detected by an intake air temperature sensor 115 installed at a lower part of the air cleaner 39 is in a predetermined range (for example, 35° C. to 45° C.), and then proceeds to the step S23.

In the step S23, the control unit 111 determines whether or not the degree of opening of the throttle valve 26 detected by the throttle opening degree sensor 103 is in a substantially, completely closed state (the degree of opening of about 1% or less), and the step proceeds to the step S24 when the substantially, completely closed state is confirmed.

In the step S24, the control unit 111 determines whether or not the engine speed over a predetermined time Z2 (for example, 20 seconds) is within a predetermined range (for example, ±300 rpm) with respect to a predetermined idle speed (for example, 1500 rpm), and in the case where it is in the predetermined range, the control unit 111 determines that the engine speed is in a stable idling state, and proceeds to step S25.

In the step S25, the control unit 111 determines whether or not the vehicle speed detected by a vehicle speed sensor, not illustrated, is at a predetermined value (for example, 5 km/h) or lower, and in the case where it is at or below the predetermined value, proceeds to step S26.

This step S25 is set so as to eliminate the possibility of learning of a detected value of the intake pressure sensor (step S28) being performed due to the conditions of steps S22, S23, S24, S26 and S27 being satisfied because of short-circuiting of the maintenance terminal 112 by rainwater or the like at a time other than the maintenance of the all terrain vehicle 1. Here, the set value of the vehicle speed is 5 km/h, not 0 km/h, to eliminate the influence of variation in the vehicle speed sensors.

In the step S26, the control unit 111 determines whether or not the intake negative pressure detected by the intake pressure sensor 102 is within a predetermined range (for example, ±5 kPa) with respect to a set value for idling of the engine 28 (for example, about 60 kPa), and in the case where it is within the predetermined range, proceeds to the step S27. The step S26 is set so as to prevent learning of a detected value of the intake pressure sensor 102 (step S28) in a case where the intake pressure sensor 102 is malfunctioning, for example.

In the step S27, the control unit 111 determines whether or not a state where all of the conditions of steps S21 to S26 are satisfied "YES" has been continuing for a predetermined time Z3 (for example, 30 seconds), and only in the case where it has been continuing, performs learning of a detected value of the intake pressure sensor 102 in the step S28.

The control unit 111 performs learning of a detected value of the intake pressure sensor 102 in the step S28 in the following manner. The control unit 111 compares a detected value K of the intake negative pressure detected by the intake pressure sensor 102 at the time of satisfaction of the condition of the step S27 with an initial value K0 of the intake negative pressure detected by the intake pressure sensor 102 at the time of idling at the time of shipping of the all terrain vehicle 1 from the factory, obtains the amount of change (the amount of deviation) δ of the detected value K with respect to the initial value K0, and grasps the property of the intake pressure sensor 102. The control unit 111 thereafter performs learning in such a way as to correct a detected value P of the intake negative pressure detected by the intake pressure sensor 102 based on the property. That is, the control unit 111 performs learning by taking the amount of change δ as a correction value, taking the correction value δ into account (addition or subtraction) with respect to a detected value P1 of the intake negative pressure later detected by the intake pressure sensor 102, performing correction of removing the amount of change δ from the detected value P1 of the intake negative pressure detected by the intake pressure sensor 102 and obtaining an accurate value P2 of the intake negative pressure.

The abnormality determination for the ISC valve 92 can be accurately performed by using the value P2 of the intake negative pressure learned in the above-mentioned way as the value of the intake negative pressure of the step S5 in the abnormality determination control (FIG. 8) for the ISC valve 92 (the intake negative pressure detected by the intake pressure sensor 102). Further, in the predetermined engine operation state in the intake pressure sensor learning control described above, there is no need that the vehicle speed of the all terrain vehicle 1 is at or below a predetermined value (step S25).

With the configuration described above, also in the second embodiment, the control unit 111 performs the engine output suppression control shown in FIGS. 8 and 9 (the abnormality determination control for the ISC valve 92 and the idle overspeed prevention control), and thus, the following effects (2) to (4), as well as the same effect as effect (1) of the first embodiment, will be achieved.

(2) With the control unit 111 learning in such a way as to correct a value detected by the intake pressure sensor 102 based on the property (the amount of change δ) of the intake pressure sensor 102, a value of the intake negative pressure detected by the intake pressure sensor 102 can be made an accurate value. As a result, the influence of individual differences or deterioration in elapsed time of the intake pressure sensors 102 of respective vehicles can be eliminated, and the abnormality determination control for the ISC valve 92 can be performed with high accuracy.

(3) The control unit 111 recognizes the maintenance state of the all terrain vehicle 1 by detecting the connected state of the maintenance terminal 112, and performs the intake pressure sensor learning control in this maintenance state. It is not necessary to perform this intake pressure sensor learning control frequently, and to perform at the time of maintenance of the all terrain vehicle 1, and thus, the burdensomeness can be eliminated.

(4) Since the control unit 111 recognizes the maintenance state of the all terrain vehicle 1 by checking the connected state of the maintenance terminal 112 for plugging in the special tool 113 that is used at the time of maintenance of the all terrain vehicle 1, it is not necessary to separately locate a switch or the like for checking the maintenance state of the all terrain vehicle 1, thus preventing the cost from increasing.

It is further to be noted that the present invention is not limited to the embodiments described hereinabove, and various changes and modifications may be made without departing from the spirit or scope of the present invention of the appended claims.

For example, there was described, in the first embodiment, a case of performing the ignition thinning out control as the engine output suppression control (the idle overspeed prevention control), but an injection thinning out control by the fuel injector 27 may be performed instead of, or together with, the ignition thinning out control. Furthermore, an intake pressure sensor 102 dedicated to the engine output suppression control (the abnormality determination control for the ISC valve 92) may be separately installed. Moreover, the present invention may be applied to the control of the ISC device of not only the all terrain vehicle 1, but also of a motorcycle, a four-wheeled vehicle or the like.

What is claimed is:

1. An engine control device of an engine including an idle speed control (ISC) device provided for an intake bypass passage connecting an upper side and a lower side of a throttle valve installed in an intake passage so as to control an idle speed of the engine by adjusting an amount of air flowing through the intake bypass passage at a time of idling of the engine, the engine control device comprising:

a throttle opening degree sensor disposed in the intake passage and configured to detect a degree of opening of the throttle valve;

an intake pressure sensor disposed in the intake passage and configured to detect an intake negative pressure at the lower side of the throttle valve; and a control unit configured to control an output of the engine, wherein the control unit is configured to perform engine output suppression control by suppressing the output of the engine after determining that an ISC valve of the ISC device is abnormal based on the degree of opening of the throttle valve detected by the throttle opening degree sensor being within a predetermined range, the intake negative pressure detected by the intake pressure sensor being lower than a threshold value, detection of an increase in engine speed that is more than a first predetermined amount within a predetermined time during a first engine speed increase determination step, and detection of an increase in engine speed that is more than a second predetermined amount within a second predetermined time, wherein the second predetermined time is longer than the first predetermined time.

2. The engine control device according to claim 1, wherein the control unit is configured to compare the intake negative pressure detected by the intake pressure sensor with the threshold value, wherein the intake negative pressure is detected when the degree of opening of the throttle valve detected by the throttle opening degree sensor is within a predetermined range indicating a completely closed region and the engine speed is at a predetermined value or higher after an increase in the engine speed by a predetermined amount or more is detected within a predetermined time.

3. The engine control device according to claim 2, wherein the predetermined value of the engine speed is set to be higher than an idle speed of the engine when the ISC valve is normal, and lower than the engine speed at a time of engagement of an automatic centrifugal clutch.

4. The engine control device according to claim 2, wherein a step of detecting whether or not there is an increase in the engine speed by the predetermined amount or more within the predetermined time is a step of sequentially performing the first engine speed increase determination and the second engine speed increase determination.

5. The engine control device according to claim 1, wherein the engine output suppression control is an ignition thinning out control of performing ignition of only a given number of cycles among a plurality of successive cycles of the engine.

6. The engine control device according to claim 1, wherein the control unit is configured to perform the engine output suppression control after a specific time has elapsed after an abnormality of the ISC valve has been determined.

7. The engine control device according to claim 1, wherein a plurality of threshold values for the intake negative pressure differ from each other depending on the degree of opening of the ISC valve at a time of fixation of the ISC valve, and the control unit is configured to perform different engine output suppression controls respectively correspondingly to the plurality of threshold values.

8. The engine control device according to claim 1, wherein the control unit is configured to, at a time when a predetermined condition is satisfied, recognize a property of the intake pressure sensor based on a detected value of the intake negative pressure detected by the intake pressure sensor in a predetermined engine operation state, and perform an intake pressure sensor learning control of performing learning so as to correct, based on the recognized property, the detected value of the intake negative pressure detected by the intake pressure sensor.

9. The engine control device according to claim 8, wherein the satisfaction time of the predetermined condition is a satisfaction time of a condition indicating that a vehicle on which the engine is mounted is in a maintenance state, and the intake pressure sensor learning control is performed at a time of the maintenance.

10. The engine control device according to claim 9, wherein the control unit is configured to recognize the maintenance state of the vehicle by detecting a connected state of a maintenance terminal for plugging in a tool that is used at a time of the maintenance of the vehicle.

11. The engine control device according to claim 8, wherein the predetermined engine operation state is a state in which all of a state where an indicator indicating a warm-up state of the engine indicates that the engine is in a warmed-up state, a state where the throttle valve is in a substantially completely closed state, a state where the engine speed is in a stable idling state, and a state where each of the states has been continuing for a predetermined time, are satisfied.

12. The engine control device according to claim 11, wherein continuance, over a predetermined time, of a state where the intake negative pressure is within a predetermined range with respect to a set value for idling of the engine is added to the predetermined engine operation state.

13. The engine control device according to claim 11, wherein continuance, over a predetermined time, of a state where a vehicle speed is at a predetermined value or lower is added to the predetermined engine operation state.

14. An engine control method of an engine including an idle speed control (ISC) valve provided for an intake bypass passage connecting an upper side and a lower side of a throttle valve installed in an intake passage and that controls an idle speed of the engine by adjusting an amount of air flowing through the intake bypass passage at a time of idling of the engine, wherein an engine output suppression control of suppressing an output of the engine is performed after determining that the ISC valve is abnormal based on a degree of opening of the throttle valve being within a predetermined range, an intake negative pressure at the lower side of the throttle valve in the intake passage being lower then a threshold value, detection of an increase in engine speed that is more than a first predetermined amount within a predetermined time during a first engine speed increase determination step, and detection of an increase in engine speed that is more than a second predetermined amount within a second predetermined time, wherein the second predetermined time is longer than the first predetermined time.

* * * * *